US009902179B2

(12) United States Patent
Yamanobe

(10) Patent No.: US 9,902,179 B2
(45) Date of Patent: Feb. 27, 2018

(54) INK JET RECORDING DEVICE AND DENSITY UNEVENNESS CORRECTION METHOD THEREFOR

(71) Applicant: FUJIFILM Corporation, Tokyo (JP)

(72) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/481,474

(22) Filed: Apr. 7, 2017

(65) Prior Publication Data

US 2017/0291440 A1 Oct. 12, 2017

(30) Foreign Application Priority Data

Apr. 7, 2016 (JP) ..... 2016-077268

(51) Int. Cl.

| | |
|---|---|
| ***B41J 11/057*** | (2006.01) |
| ***B41J 29/393*** | (2006.01) |
| ***B41J 2/21*** | (2006.01) |
| ***B41J 13/22*** | (2006.01) |

(52) U.S. Cl.

CPC ..... *B41J 29/393* (2013.01); *B41J 2/2132* (2013.01); *B41J 2/2139* (2013.01); *B41J 2/2142* (2013.01); *B41J 2/2146* (2013.01); *B41J 11/057* (2013.01); *B41J 13/223* (2013.01); *B41J 2029/3935* (2013.01)

(58) Field of Classification Search

CPC B41J 11/057; B41J 13/223; B41J 2029/3935; B41J 2/2132; B41J 2/2139

See application file for complete search history.

(56) References Cited

U.S. PATENT DOCUMENTS

| | | | | |
|---|---|---|---|---|
| 9,522,543 | B2 * | 12/2016 | Ueshima | B41J 2/205 |
| 9,643,411 | B2 * | 5/2017 | Watanabe | B41J 2/2135 |
| 9,694,598 | B2 * | 7/2017 | Ishikawa | B41J 2/2139 |
| 9,776,425 | B2 * | 10/2017 | Kyoso | B41J 2/2132 |
| 2010/0165033 | A1 | 7/2010 | Fukui | |
| 2014/0354727 | A1 | 12/2014 | Sasayama | |

FOREIGN PATENT DOCUMENTS

| | | |
|---|---|---|
| JP | 2010149417 | 7/2010 |
| JP | 2014231155 | 12/2014 |

OTHER PUBLICATIONS

"Search Report of Europe Counterpart Application", dated Sep. 19, 2017, p. 1-p. 6.

* cited by examiner

*Primary Examiner* — Lamson Nguyen
(74) *Attorney, Agent, or Firm* — JCIPRNET

(57) ABSTRACT

In an ink jet recording device in which a paper supporting part is constituted by a first support and a second support having a comb teeth structure, a region where paper is supported by only the first support is defined as a first region, a region where the paper is supported by only the second support is defined as a second region, and a region where the paper is supported by the first support and the second support is defined as a third region. Charts including a plurality of grayscales for the respective regions are drawn. The respective drawn charts are read by an image reader. Correction values of density unevenness are obtained for the respective regions on the basis of the reading results. Density data of an image are corrected for the respective regions on the basis of the correction values of the density unevenness for the respective regions.

17 Claims, 30 Drawing Sheets

INK JET RECORDING DEVICE AND DENSITY UNEVENNESS CORRECTION METHOD THEREFOR

CROSS-REFERENCE TO RELATED APPLICATIONS

The present application claims priority under 35 U.S.C. § 119 to Japanese Patent Application No. 2016-077268, filed on Apr. 7, 2016. The above application is hereby expressly incorporated by reference, in its entirety, into the present application.

BACKGROUND OF THE INVENTION

1. Field of the Invention

The present invention relates to an ink jet recording device and a density unevenness correction method therefor.

2. Description of the Related Art

Drum transportation is known as one of methods for transporting media in ink jet recording devices. The drum transportation is a method for winding a medium around a peripheral surface of a rotating drum to transport the medium.

A drum in which a supporting part for a medium is extendable and retractable is described in JP2010-149417A. In this drum, the supporting part for the medium is constituted by a pair of supports having a comb teeth structure. The comb teeth structure is a structure in which supporting pieces that support the medium are arranged at regular intervals in the shape of comb teeth. The supporting part for the medium is disposed such that the pair of supports having the comb teeth structure are engaged with each other, and is thereby configured in an extendable and retractable manner.

SUMMARY OF THE INVENTION

Meanwhile, if the supporting part for the medium is constituted by the supports having the comb teeth structure as in the drum described in JP2010-149417A, a region where the medium is supported in contact with the supports, and a region where the medium is supported without contacting the supports are generated when the medium is supported. As a result, the following problems occur. For example, in a case where the temperature of the medium and the temperature of the supports are different from each other, variation occurs in the temperature distribution of the entire medium. For example, in a case where the temperature of the medium is higher than the temperature of the supports, the temperature of portions contacting the supports becomes low, and variation occurs in the temperature distribution of the entire medium. If the variation occurs in the temperature distribution of the entire medium, even in a case where the same amount of ink droplets are dropped, the diameter of dots changes, the degree of landing interference changes, or density unevenness occurs.

For example, as described in JP2014-231155A, it is also considered that the density unevenness is solved by an image processing technique.

However, since related-art density unevenness correction is a method of outputting a test chart to obtain a correction value required for correction of the density unevenness, the following problems occur if this method is applied. That is, since the temperature distribution occurring in the medium is not uniform as a whole, if the related-art technique is applied as it is, there is a problem that the density unevenness is rather worsened.

The invention has been made in view of such circumstances, and an object thereof is to provide an ink jet recording device and a density unevenness correction method therefor that can appropriately correct density unevenness in the ink jet recording device in which a medium supporting part is constituted by a support having a comb teeth structure.

The means for solving the above problems is as follows.

(1) A density unevenness correction method for an image of an ink jet recording device, the ink jet recording device including transporting means having a medium supporting part configured such that a first support having a plurality of first supporting pieces arranged in the shape of comb teeth thereon and a second support having a plurality of second supporting pieces arranged in the shape of comb teeth thereon are engaged with each other and are extendable and retractable, and bringing a medium into close contact with the medium supporting part to transport the medium, and a line-type ink jet head that draws an image with a single pass on the medium transported by the transporting means, the density unevenness correction method comprising: a test chart output step of outputting a test chart including a plurality of grayscales; a test chart read step of reading an image of the output test chart; a first density unevenness correction value derivation step of deriving a first density unevenness correction value, which is a correction value of density unevenness in a first region, from a reading result of the test chart, in a case where a region where the medium is supported by only the first support is defined as the first region; a second density unevenness correction value derivation step of deriving a second density unevenness correction value, which is a correction value of density unevenness in a second region, from the reading result of the test chart, in a case where a region where the medium is supported by only the second support is defined as the second region; a third density unevenness correction value derivation step of deriving a third density unevenness correction value, which is a correction value of density unevenness in a third region, from the reading result of the test chart, in a case where a region where the medium is supported by the first support and the second support is defined as the third region; and a density unevenness correction step of correcting data of an image to be drawn on the medium for each region on the basis of the correction value of the density unevenness for each region.

According to this aspect, the density unevenness correction is performed in the following procedure. First, the test chart including the plurality of grayscales is output. That is, the medium is transported by the transporting means, and the test chart is drawn on the medium by the ink jet head. Next, the image of the output test chart is read by the image reading means. The reading can be performed either inline or offline. The inline is an aspect in which the reading of the image is performed within the ink jet recording device. The offline is an aspect of which the reading of the image is performed out of the ink jet recording device. Next, the first density unevenness correction value, the second density unevenness correction value, and the third density unevenness correction value are obtained on the basis of the reading result of the test chart. Here, the first density unevenness correction value is the correction value of the density unevenness in the first region of the medium. The first region is the region where the medium is supported by only the first support. Both of a region where the paper is supported in close contact with the first supporting pieces, a region where the paper is supported without being in close contact with the first supporting pieces, that is, a region where the paper is supported in the state of floating between the first supporting pieces adjacent to each other are included in this first region. Additionally, the second density unevenness correction value is the correction value of the density unevenness in the second region of the medium. The second region is the region where the medium is supported by only the second support. Both of a region where the paper is supported in close contact with the second supporting pieces, a region where the paper is supported without being in close contact with the second supporting pieces, that is, a region where the paper is supported in the state of floating between the second supporting pieces adjacent to each other are included in this second region. Additionally, the third density unevenness correction value is the correction value of the density unevenness in the third region of the medium. The third region is the region where the medium is supported by the first support and the second support, and is a region where the second supporting pieces of the second support are engaged with the first supporting pieces of the first support. Additionally, the first density unevenness correction value, the second density unevenness correction value, and the third density unevenness correction value are obtained from the reading result of the test chart. Then, density data of the image to be drawn on the medium are corrected for each region on the basis of the obtained correction value of the density unevenness for each region. That is, data of the first region are corrected on the basis of the first density unevenness correction value, data of the second region are corrected on the basis of the second density unevenness correction value, and data of the third region are corrected on the basis of the third density unevenness correction value. Accordingly, in the ink jet recording device in which the medium supporting part is supported by the supports having the comb teeth structure, the density unevenness can be corrected appropriately, and a high-quality image can be drawn.

(2) The density unevenness correction method for an ink jet recording device according to the above (1) in which the test chart includes a first chart that is a chart including a plurality of grayscales and is drawn in the first region, a second chart that is a chart including a plurality of grayscales and is drawn in the second region, and a third chart that is a chart including a plurality of grayscales and is drawn in the third region, in which the first density unevenness correction value derivation step derives the first density unevenness correction value from a reading result of the first chart, in which the second density unevenness correction value derivation step derives the second density unevenness correction value from a reading result of the second chart, and in which the third density unevenness correction value derivation step derives the third density unevenness correction value from a reading result of the third chart.

According to this aspect, the test chart has a configuration including the first chart, the second chart, and the third chart. The first chart is a chart to be drawn in the first region, and is constituted by a chart including a plurality of grayscales. The first density unevenness correction value is obtained on the basis of the reading result of the first chart. The second chart is a chart to be drawn in the second region, and is constituted by a chart including a plurality of grayscales. The second density unevenness correction value is obtained on the basis of the reading result of the second chart. The third chart is a chart to be drawn in the third region, and is constituted by a chart including a plurality of grayscales. The third density unevenness correction value is obtained on the basis of the reading result of the third chart.

(3) The density unevenness correction method for an ink jet recording device according to the above (1), in which the test chart includes a first chart that is a chart including a plurality of grayscales and is drawn in the first region, and a second chart that is a chart including a plurality of grayscales and is drawn in the second region, in which the density unevenness correction method further comprises: a main density unevenness component derivation step of calculating an average of a reading result of the first chart and a reading result of the second chart, to derive a main density unevenness component that is a density unevenness component resulting from the ink jet head, a first density unevenness component derivation step of calculating a difference between the reading result of the first chart and the main density unevenness component, to derive a first density unevenness component that is a density unevenness component resulting from the first support, and a second density unevenness component derivation step of calculating a difference between the reading result of the second chart and the main density unevenness component, to derive a second density unevenness component that is a density unevenness component resulting from the second support, in which the first density unevenness correction value derivation step derives the first density unevenness correction value on the basis of the main density unevenness component and the first density unevenness component, in which the second density unevenness correction value derivation step derives the second density unevenness correction value on the basis of the main density unevenness component and the second density unevenness component, and in which the third density unevenness correction value derivation step derives the third density unevenness correction value on the basis of the main density unevenness component.

According to this aspect, the test chart has a configuration including the first chart and the second chart. The first chart is a chart to be drawn in the first region, and is constituted by a chart including a plurality of grayscales. The second chart is a chart to be drawn in the second region, and is constituted by a chart including a plurality of grayscales. The correction value of the density unevenness of each region is obtained as follows on the basis of the reading result of the test chart including the first chart and the second chart. First, the main density unevenness component is obtained by calculating the average of the reading result of the first chart and the reading result of the second chart. The main density unevenness component is the density unevenness component resulting from the ink jet head, and is a component of density unevenness from which the influence of the medium supporting part is excluded. The component of the density unevenness from which the influence of the medium supporting part is excluded can be obtained by calculating the average of the reading result of the first chart and the reading result of the second chart. Next, the first density unevenness component is obtained by calculating the difference between the reading result of the first chart and the main density unevenness component. The first density unevenness component is the density unevenness component resulting from the first support. That is, the first density unevenness component is a pattern of density unevenness that appears according to arrangement intervals of the first supporting pieces. Similarly, the second density unevenness component is obtained by calculating the difference between the reading result of the second chart and the main density unevenness component. The second density unevenness component is the density unevenness component resulting from the second support. That is, the second density unevenness component is a pattern of density unevenness that appears according to arrangement intervals of the second supporting pieces. On the basis of the main density unevenness component, the first density unevenness component, and the second density unevenness component that are obtained in this way, the correction value of the density unevenness is obtained for each region. That is, the first density unevenness correction value is obtained on the basis of the main density unevenness component and the first density unevenness component, and the second density unevenness correction value is obtained on the basis of the main density unevenness component and the second density unevenness component. Additionally, the third density unevenness correction value is obtained on the basis of the main density unevenness component.

(4) The density unevenness correction method for an ink jet recording device according to the above (3), in which the test chart further includes a third chart that is a chart including a plurality of grayscales and is drawn in the third region, and in which the main density unevenness component derivation step calculates an average of the reading result of the first chart, the reading result of the second chart, and the reading result of the third chart, to derive the main density unevenness component.

According to this aspect, the third chart is further included in the test chart. The third chart is a chart to be drawn in the third region, and is constituted by a chart including a plurality of grayscales. The main density unevenness component is obtained by calculating the average of the reading result of the first chart, the reading result of the second chart, and the reading result of the third chart.

(5) The density unevenness correction method for an ink jet recording device according to the above (1), further comprising: a density unevenness component derivation step of deriving a main density unevenness component, which is a density unevenness component originating from the ink jet head, from the reading result of the test chart, a first density unevenness component that is a density unevenness component resulting from the first support, and a second density unevenness component that is a density unevenness component resulting from the second support, in which the first density unevenness correction value derivation step derives the first density unevenness correction value on the basis of the main density unevenness component and the first density unevenness component, in which the second density unevenness correction value derivation step derives the second density unevenness correction value on the basis of the main density unevenness component and the second density unevenness component, and in which the third density unevenness correction value derivation step derives the third density unevenness correction value on the basis of the main density unevenness component.

In this aspect, the main density unevenness component, the first density unevenness component, and the second density unevenness component are obtained from the reading result of the test chart. Then, the first density unevenness correction value is obtained on the basis of the main density unevenness component and the first density unevenness component. Additionally, the second density unevenness correction value is obtained on the basis of the main density unevenness component and the second density unevenness component. Additionally, the third density unevenness correction value is obtained on the basis of the obtained main density unevenness component.

(6) The density unevenness correction method for an ink jet recording device according to the above (5), in which the density unevenness component derivation step includes a main density unevenness component derivation step of deriving the main density unevenness component from the reading result of the test chart, a first density unevenness component derivation step of calculating a difference between the reading result of the test chart and the main density unevenness component, to derive the first density unevenness component, and a second density unevenness component derivation step of calculating a difference between the reading result of the test chart and the main density unevenness component, to derive the second density unevenness component.

In this aspect, when the main density unevenness component, the first density unevenness component, and the second density unevenness component are obtained from the reading result of the test chart, first, the main density unevenness component is obtained. Then, the first density unevenness component is obtained from the difference between the obtained main density unevenness component and the reading result of the test chart. Additionally, the second density unevenness component is obtained from the difference between the obtained main density unevenness component and the reading result of the test chart.

(7) The density unevenness correction method for an ink jet recording device according to the above (6), in which the main density unevenness component derivation step includes a step of Fourier-transforming the reading result of the test chart to decompose the transformed reading result into a plurality of frequency components, a step of removing a fundamental frequency and a frequency component of an integral multiple of the fundamental frequency from the reading result of the test chart after the Fourier transform, in a ease where a frequency matching arrangement intervals of the first supporting pieces and the second supporting pieces is defined as the fundamental frequency, and a step of inverse-Fourier-transforming the reading result of the test chart after the removal, to derive the main density unevenness component.

In this aspect, the main density unevenness component is obtained as follows. First, the reading result of the test chart is Fourier-transformed and is decomposed into the plurality of frequency components. Next, the fundamental frequency and the frequency component of the integral multiple of the fundamental frequency are removed from the reading result of the test chart after the Fourier transform. Here, the fundamental frequency is the frequency matching the arrangement intervals of the first supporting pieces and the second supporting pieces that constitute the first support and the second support. The influence of the medium supporting part can be excluded by removing the fundamental frequency and the frequency component of the integral multiple of the fundamental frequency. Next, the reading result of the test chart after the removal is inverse-Fourier-transformed. Accordingly, the main density unevenness component can be extracted from the reading result of the test chart.

(8) An ink jet recording device comprising: transporting means including a medium supporting part configured such that a first support having a plurality of first supporting pieces arranged in the shape of comb teeth thereon and a second support having a plurality of second supporting pieces arranged in the shape of comb teeth thereon are engaged with each other and are extendable and retractable, and bringing a medium into close contact with the medium supporting part to transport the medium; a line-type ink jet head that draws an image with a single pass on the medium transported by the transporting means; image reading means for reading the image drawn on the medium; a test chart output control unit that outputs a test chart including a plurality of grayscales; a test chart reading control unit that makes the image reading means read an image of the output test chart; a first density unevenness correction value derivation unit that derives a first density unevenness correction value, which is a correction value of density unevenness in a first region, from a reading result of the test chart, in a case where a region where the medium is supported by only the first support is defined as the first region; a second density unevenness correction value derivation unit that derives a second density unevenness correction value, which is a correction value of density unevenness in a second region, from the reading result of the test chart, in a case where a region where the medium is supported by only the second support is defined as the second region; a third density unevenness correction value derivation unit that derives a third density unevenness correction value, which is a correction value of density unevenness in a third region, from the reading result of the test chart, in a case where a region where the medium is supported by the first support and the second support is defined as the third region; and a density unevenness correction unit that corrects data of an image to be drawn on the medium for each region on the basis of the correction value of the density unevenness for each region.

According to this aspect, the density unevenness correction is performed in the following procedure. First, the test chart including the plurality of grayscales is output. The output of the test chart is performed under the control using the test chart output control unit. Next, the image of the output test chart is read by the image reading means. The reading is performed under the control using the test chart reading control unit. Next, the first density unevenness correction value, the second density unevenness correction value, and the third density unevenness correction value are obtained on the basis of the reading result of the test chart. The first density unevenness correction value is obtained by the first density unevenness correction value derivation unit. The second density unevenness correction value is obtained by the second density unevenness correction value derivation unit. The third density unevenness correction value is obtained by the third density unevenness correction value derivation unit. Density data of the image to be drawn on the medium are corrected for each region on the basis of the obtained correction value of the density unevenness for each region. The correction is performed by the density unevenness correction unit. The density unevenness correction unit corrects data of the first region on the basis of the first density unevenness correction value, corrects data of the second region on the basis of the second density unevenness correction value, and corrects data of the third region on the basis of the third density unevenness correction value. Accordingly, in the ink jet recording device in which the medium supporting part is constituted by the supports having the comb teeth structure, the density unevenness can be corrected appropriately, and a high-quality image can be drawn.

(9) The ink jet recording device according to the above (8), in which the test chart includes a first chart that is a chart including a plurality of grayscales and is drawn in the first region, a second chart that is a chart including a plurality of grayscales and is drawn in the second region, and a third chart that is a chart including a plurality of grayscales and is drawn in the third region, in which the first density unevenness correction value derivation unit derives the first density unevenness correction value from a reading result of the first chart, in which the second density unevenness correction value derivation unit derives the second density unevenness correction value from a reading result of the second chart, and in which the third density unevenness correction value derivation unit derives the third density unevenness correction value from a reading result of the third chart.

According to this aspect, the test chart has a configuration including the first chart, the second chart, and the third chart. The first chart is a chart to be drawn in the first region, and is constituted by a chart including a plurality of grayscales. The first density unevenness correction value derivation unit derives the first density unevenness correction value from the reading result of the first chart. The second chart is a chart to be drawn in the second region, and is constituted by a chart including a plurality of grayscales. The second density unevenness correction value derivation unit derives the second density unevenness correction value from the reading result of the second chart. The third chart is a chart to be drawn in the third region, and is constituted by a chart including a plurality of grayscales. The third density unevenness correction value derivation unit derives the third density unevenness correction value from the reading result of the third chart.

(10) The ink jet recording device according to the above (8), in which the test chart includes a first chart that is a chart including a plurality of grayscales and is drawn in the first region, and a second chart that is a chart including a plurality of grayscales and is drawn in the second region, in which the ink jet recording device further comprises: a main density unevenness component derivation unit that calculates an average of a reading result of the first chart and a reading result of the second chart, to derive a main density unevenness component that is a density unevenness component resulting from the ink jet head, a first density unevenness component derivation unit that calculates a difference between the reading result of the first chart and the main density unevenness component, to derive a first density unevenness component that is a density unevenness component resulting from the first support, and a second density unevenness component derivation unit that calculates a difference between the reading result of the second chart and the main density unevenness component, to derive a second density unevenness component that is a density unevenness component resulting from the second support, in which the first density unevenness correction value derivation unit derives the first density unevenness correction value on the basis of the main density unevenness component and the first density unevenness component, in which the second density unevenness correction value derivation unit derives the second density unevenness correction value on the basis of the main density unevenness component and the second density unevenness component, and in which the third density unevenness correction value derivation unit derives the third density unevenness correction value on the basis of the main density unevenness component.

According to this aspect, the test chart has a configuration including the first chart and the second chart. The first chart is a chart to be drawn in the first region, and is constituted by a chart including a plurality of grayscales. The second chart is a chart to be drawn in the second region, and is constituted by a chart including a plurality of grayscales. The correction value of the density unevenness of each region is obtained as follows on the basis of the reading result of the test chart including the first chart and the second chart. First, the main density unevenness component is obtained by calculating the average of the reading result of the first chart and the reading result of the second chart. The main density unevenness component is obtained by the main density unevenness component derivation unit. Next, the first density unevenness component is obtained by calculating the difference between the reading result of the first chart and the main density unevenness component. The first density unevenness component is obtained by the first density unevenness component derivation unit. Similarly, the second density unevenness component is obtained by calculating the difference between the reading result of the second chart and the main density unevenness component. The second density unevenness component is obtained by the second density unevenness component derivation unit. On the basis of the main density unevenness component, the first density unevenness component, and the second density unevenness component that are obtained in this way, the correction value of the density unevenness is obtained for each region. That is, the first density unevenness correction value derivation unit obtains the first density unevenness correction value on the basis of the main density unevenness component and the first density unevenness component. The second density unevenness correction value derivation unit obtains the second density unevenness correction value on the basis of the main density unevenness component and the second density unevenness component. The third density unevenness correction value derivation unit obtains the third density unevenness correction value on the basis of the main density unevenness component.

(11) The ink jet recording device according to the above (10), in which the test chart further includes a third chart that is a chart including a plurality of grayscales and is drawn in the third region, and in which the main density unevenness component derivation unit calculates an average of the reading result of the first chart, the reading result of the second chart, and the reading result of the third chart, to derive the main density unevenness component.

According to this aspect, the third chart is further included in the test chart. The third chart is a chart to be drawn in the third region, and is constituted by a chart including a plurality of grayscales. The main density unevenness component derivation unit obtains the main density unevenness component by calculating the average of the reading result of the first chart, the reading result of the second chart, and the reading result of the third chart.

(12) The ink jet recording device according to the above (8), further comprising: a density unevenness component derivation unit that derives a main density unevenness component, which is a density unevenness component originating from the ink jet head, from the reading result of the test chart, a first density unevenness component that is a density unevenness component resulting from the first support, and a second density unevenness component that is a density unevenness component resulting from the second support, in which the first density unevenness correction value derivation unit derives the first density unevenness correction value on the basis of the main density unevenness component and the first density unevenness component, in which the second density unevenness correction value derivation unit derives the second density unevenness correction value on the basis of the main density unevenness component and the second density unevenness component, and in which the third density unevenness correction value derivation unit derives the third density unevenness correction value on the basis of the main density unevenness component.

In this aspect, the main density unevenness component, the first density unevenness component, and the second density unevenness component are obtained from the reading result of the test chart by the density unevenness component derivation unit. The first density unevenness correction value derivation unit obtains the first density unevenness correction value on the basis of the main density unevenness component and the first density unevenness component that are obtained. The second density unevenness correction value derivation unit obtains the second density unevenness correction value on the basis of the main density unevenness component and the second density unevenness component that are obtained. The third density unevenness correction value derivation unit obtains the third density unevenness correction value on the basis of the obtained main density unevenness component.

(13) The ink jet recording device according to the above (12), in which the density unevenness component derivation unit includes a main density unevenness component derivation unit that derives the main density unevenness component from the reading result of the test chart, a first density unevenness component derivation unit that calculates a difference between the reading result of the test chart and the main density unevenness component, to derive the first density unevenness component, and a second density unevenness component derivation unit that calculates a difference between the reading result of the test chart and the main density unevenness component, to derive the second density unevenness component.

In this aspect, the main density unevenness component is obtained from the reading result of the test chart by the main density unevenness component derivation unit. Then, the first density unevenness component is obtained from the difference between the obtained main density unevenness component and the reading result of the test chart by the first density unevenness component derivation unit. Additionally, the second density unevenness component is obtained from the difference between the obtained main density unevenness component and the reading result of the test chart by the second density unevenness component derivation unit.

(14) the ink jet recording device according to the above (13), in which the main density unevenness component derivation unit Fourier-transforms the reading result of the test chart to decompose the transformed reading result into a plurality of frequency components, removes a fundamental frequency and a frequency component of an integral multiple of the fundamental frequency from the reading result of the test chart after the Fourier transform, in a case where a frequency matching arrangement intervals of the first supporting pieces and the second supporting pieces is defined as the fundamental frequency, and inverse-Fourier-transforms the reading result of the test chart after the removal, to derive the main density unevenness component.

In this aspect, the main density unevenness component is obtained as follows. First, the reading result of the test chart is Fourier-transformed and is decomposed into the plurality of frequency components. Next, the fundamental frequency and the frequency component of the integral multiple of the fundamental frequency are removed from the reading result of the test chart after the Fourier transform. Next, the reading result of the test chart after the removal is inverse-Fourier-transformed. Accordingly, the main density unevenness component can be extracted from the reading result of the test chart.

(15) The ink jet recording device according to any one of the above (8) to (14), in which the transporting means is a drum including the medium supporting part on an outer peripheral part thereof, and transports the medium by the rotation of the drum.

According to this aspect, the transporting means is constituted by the drum. The drum includes the medium supporting part at the outer peripheral part thereof, and rotates to transport the medium.

(16) The ink jet recording device according to any one of the above (8) to (15), in which the transporting means transports the medium with the medium being brought in close contact with the medium supporting part with a negative pressure.

According to this aspect, the transporting means transports the medium with the medium being brought into close contact with the medium supporting part with a negative pressure.

(17) The ink jet recording device according to any one of the above (8) to (16), further comprising means for heating or cooling the transporting means.

According to this aspect, the means for heating or cooling the transporting means is provided. Accordingly, the medium can be heated or cooled if necessary.

According to the invention, in the ink jet recording device in which the medium supporting part is supported by the supports having the comb teeth structure, the density unevenness can be corrected appropriately, and a high-quality image can be drawn.

DESCRIPTION OF THE PREFERRED EMBODIMENTS

Hereinafter, preferred embodiments of the invention will be described in detail with reference to the accompanying drawings.

<<Device Configuration of Ink Jet Recording Device>>

Figure 1:
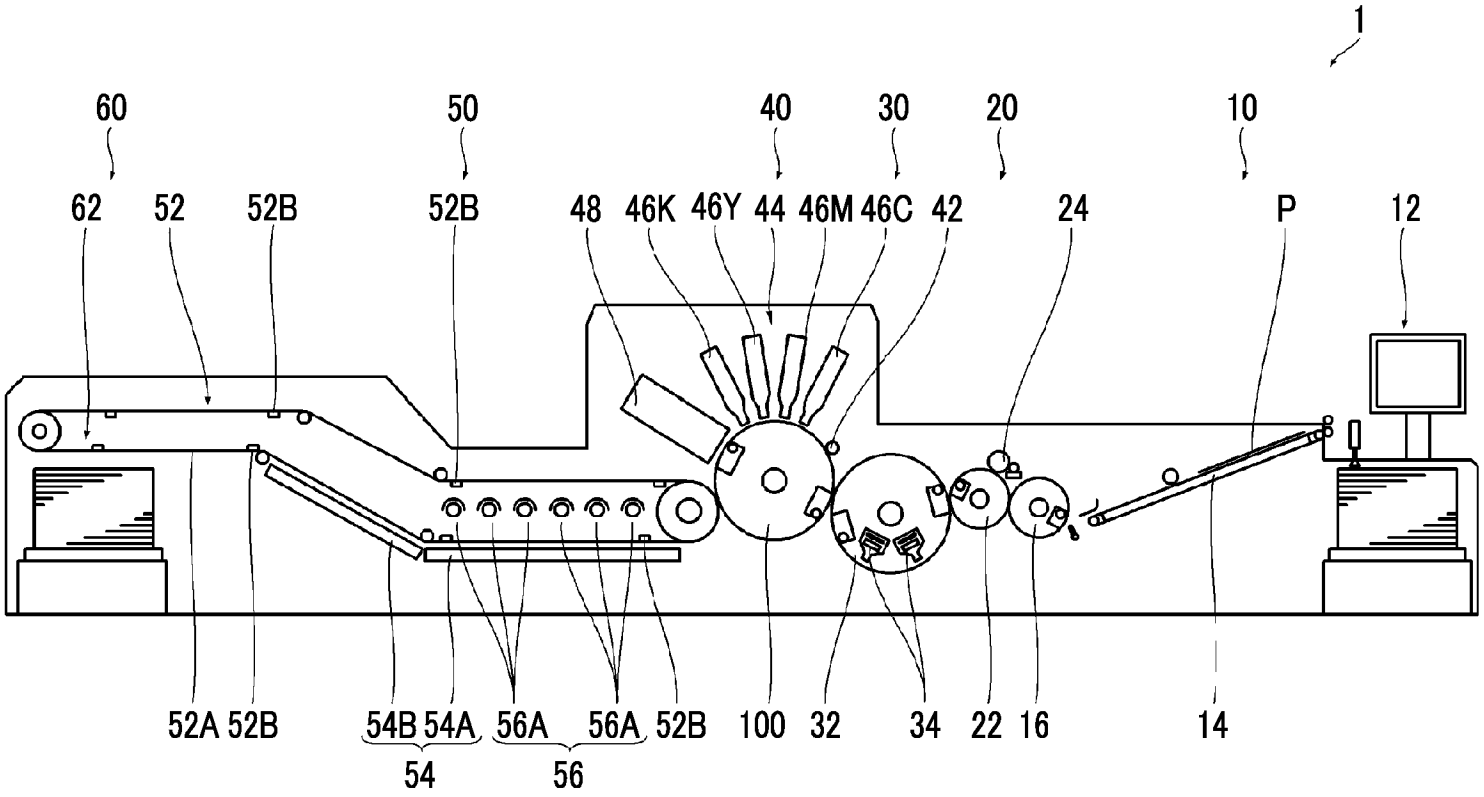
FIG. 1 is an overall configuration view illustrating an embodiment of an ink jet recording device related to the invention.

FIG. 1 is an overall configuration view illustrating an embodiment of an ink jet recording device related to the invention.

An ink jet recording device 1 illustrated in FIG. 1 is a sheet type color ink jet recording device that records a desired image on paper, which is a sheet of paper, with a single pass by using ink of four colors of cyan (C), magenta (M), yellow (Y), and black (K). Particularly, the ink jet recording device 1 of the present embodiment is an ink jet recording device that records an image on general-purpose printing paper by using aqueous ink.

Here, the single pass means a method of completing single recording of an image on paper, which is being transported, with an ink jet head being fixed at a fixed position. The single pass is also referred to as one pass.

Additionally, the general-purpose printing paper means not paper only for so-called ink jet, but paper formed mainly of cellulose, such as coated paper, which is generally used for an offset printer or the like. The general-purpose printing paper means, for example, art paper, coated paper, light-weight coated paper, cast paper, fine coated paper, or the like.

Additionally, the aqueous ink means water and ink in which the color materials, such as a dye and a pigment, are dissolved and dispersed in a solvent that is solvable in water.

As illustrated in FIG. 1, the ink jet recording device 1 is configured to mainly include a paper feed unit 10 that feeds paper P, a processing liquid coating unit 20 that coats a processing liquid on the paper P fed from the paper feed unit 10, a processing liquid drying unit 30 that performs drying processing of the paper P on which the processing liquid is coated, a drawing unit 40 that drops ink droplets in respective colors of cyan, magenta, yellow, and black on the paper P subjected to the drying processing to draw a color image, an ink drying unit 50 that performs drying processing of the paper P on which the ink droplets are dropped, and an accumulation unit 60 that accumulates the paper P subjected to the drying processing.

<Paper Feed Unit>

The paper feed unit 10 feeds the paper P that is a medium. The paper P is a sheet of paper. As illustrated in FIG. 1, the paper feed unit 10 is configured to mainly include a paper feeder 12, a feeder board 14, and a paper feed drum 16.

The paper feeder 12 takes out the paper P set on a tray in a bundle state sheet by sheet sequentially from the top, to supply the taken-out paper to the feeder board 14.

The paper feeder 12 is provided with a blower (not illustrated) in order to realize stable paper feed. The blower blows air against a paper bundle, and separates the paper P. The volume of the air that is blown off from the blower is adjustable, and is adjusted if necessary.

The feeder board 14 receives the paper P supplied from the paper feeder 12, and feeds the received paper to the paper feed drum 16.

The paper feed drum 16 receives the paper P from the feeder board 14, and transports the received paper to the processing liquid coating unit 20. The paper feed drum 16 winds the paper P around a peripheral surface thereof and transports the paper by gripping and rotating a leading end of the paper P with a gripper provided on the peripheral surface.

The paper feed unit 10 is configured as described above. The paper P is fed sheet by sheet from the paper feeder 12 to the feeder board 14, and is fed to the paper feed drum 16 by the feeder board 14. Then, the paper is transported to the processing liquid coating unit 20 by the paper feed drum 16.

<Processing Liquid Coating Unit>

The processing liquid coating unit 20 coats a processing liquid on the paper P. This processing liquid consists of liquids including the function of aggregating, insolubilizing, or viscosity-improving the color material component in ink. By coating such a processing liquid on the paper P, a high-definition image can be drawn even in a case where an image is recorded on general-purpose printing paper using aqueous ink.

The processing liquid coating unit 20 is configured to mainly include a processing liquid coating drum 22 that transports the paper P, and a processing liquid coating device 24 that coats a processing liquid on a recording surface of the paper P transported by the processing liquid coating drum 22.

The processing liquid coating drum 22 receives the paper P from the paper feed drum 16, and transports the received paper to the processing liquid drying unit 30. The processing liquid coating drum 22 winds the paper P around a peripheral surface thereof and transports the paper by gripping and rotating the leading end of the paper P with a gripper provided on the peripheral surface.

The processing liquid coating device 24 coats the processing liquid on the paper P transported by the processing liquid coating drum 22. In the present embodiment, the processing liquid is coated by a roller. That is, a roller having the processing liquid applied to a peripheral surface thereof is pressed against the paper P transported by the processing liquid coating drum 22, to coat the processing liquid. A method of coating the processing liquid is not limited to this, and a method of performing coating using an ink jet head, a method of performing coating using a spray, or the like can be used.

The processing liquid coating unit 20 is configured as described above. The paper P is coated with the processing liquid by the processing liquid coating device 24 in the process of being transported by the processing liquid coating drum 22.

<Processing Liquid Drying Unit>

The processing liquid drying unit 30 performs drying processing of the paper P on which the processing liquid is coated. The processing liquid drying unit 30 is configured to mainly include a processing liquid drying drum 32 that transports the paper P, and a processing liquid drying device 34 that blows warm air against the paper P transported by the processing liquid drying drum 32 to dry the paper P.

The processing liquid drying drum 32 receives the paper P from the processing liquid coating drum 22 of the processing liquid coating unit 20, and transports the received paper to the drawing unit 40. The processing liquid drying drum 32 is constituted by a frame body assembled in a cylindrical shape, and winds the paper P around a peripheral surface thereof and transports the paper by gripping and rotating the leading end of the paper P with a gripper provided on the peripheral surface.

The processing liquid drying device 34 is installed inside the processing liquid drying drum 32, and blows warm air toward the paper P transported by the processing liquid drying drum 32.

The processing liquid drying unit 30 is configured as described above. The paper P is blown with warm air blown from the processing liquid drying device 34 and is subjected to the drying processing, in the process of being transported by the processing liquid drying drum 32.

<Drawing Unit>

The drawing unit 40 records a color image on the recording surface of the paper P by using ink of four colors of cyan (C), magenta (M), yellow (Y), and black (K).

Figure 2:
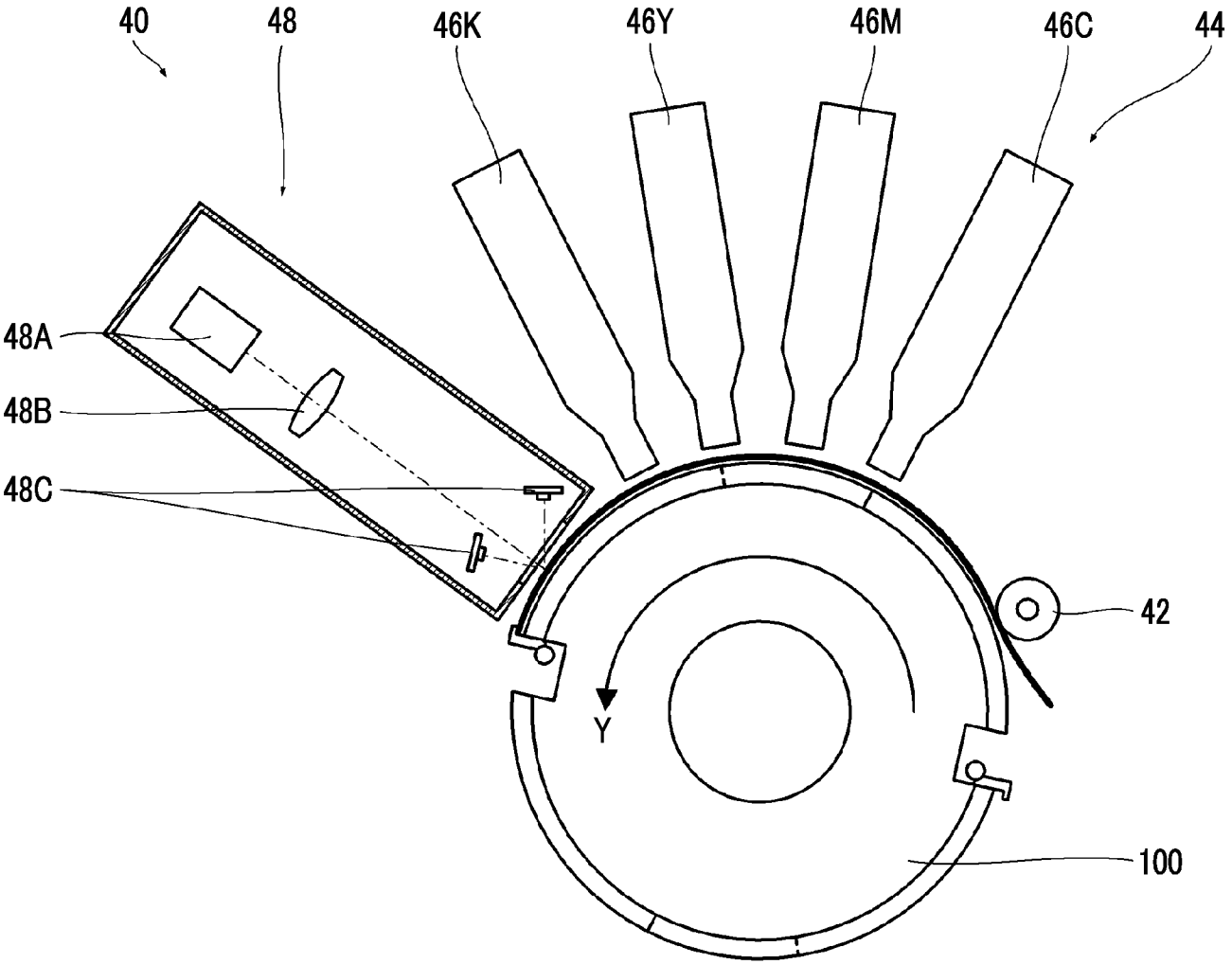
FIG. 2 is a schematic configuration diagram of a drawing unit.

FIG. 2 is a schematic configuration diagram of the drawing unit. As illustrated in FIG. 2, the drawing unit 40 is configured to mainly include a drawing drum 100 that transports the paper P along a given transporting path, a paper presser roller 42 that presses the paper P transported by the drawing drum 100 against the drawing drum 100, a drawing unit 44 that drops ink droplets in respective colors of cyan, magenta, yellow, and black on the paper P transported by the drawing drum 100 to draw a color image, and an image reader 48 that reads the image drawn on the paper P.

The drawing drum 100 is an example of transporting means. The drawing drum 100 includes a paper supporting part on an outer peripheral part thereof, and transports the paper P along the given transporting path by supporting and rotating the paper P with the paper supporting part. The paper supporting part is configured such that a first support having a plurality of first supporting pieces arranged in the shape of comb teeth thereon and a second support having a plurality of second supporting pieces arranged in the shape of comb teeth thereon are engaged with each other and are extendable and retractable. The details of the drawing drum 100 will be described below.

The paper presser roller 42 is disposed on a transporting path for the paper P by the drawing drum 100. The paper presser roller 42 presses the paper P transported by the drawing drum 100 against the drawing drum 100, and is brought into close contact with a peripheral surface of the drawing drum 100.

The drawing unit 44 is disposed on the transporting path for the paper P by the drawing drum 100. The drawing unit 44 is configured to include an ink jet head 46C that discharges ink droplets in cyan, an ink jet head 46M that discharges ink droplets in magenta, an ink jet head 46Y that discharges ink droplets in yellow, and an ink jet head 46K that discharges ink droplets in black. The respective ink jet heads 46C, 46M, 46Y, and 46K are loaded on and integrated on a carriage (not illustrated) to constitute the drawing unit 44.

The respective ink jet heads 46C, 46M, 46Y, and 46K consist of line-type ink jet heads, and draw an image with a single pass on the paper P transported by the drawing drum 100.

Each of the ink jet heads 46C, 46M, 46Y, and 46K includes a nozzle surface at a tip thereof; and discharges ink droplets toward the paper P transported by the drawing drum 100 from nozzles disposed in this nozzle surface.

Figure 3:
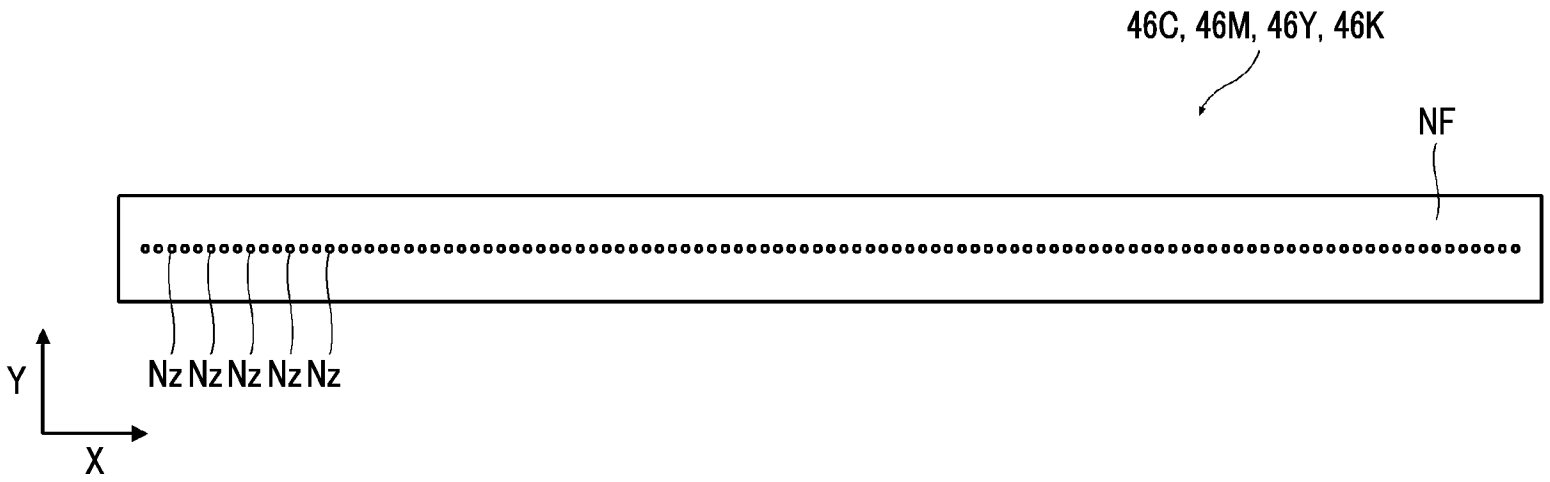
FIG. 3 is a plan view of a nozzle surface of an ink jet head.

FIG. 3 is a plan view of the nozzle surface of each ink jet head. As illustrated in this drawing, nozzles Nz are disposed at a constant pitch on a nozzle surface NF of each of the ink jet heads 46C, 46M, 46Y, and 46K. The nozzles Nz are arranged in an X direction if a transporting direction of the paper P is a Y direction and if a direction orthogonal to the Y direction is the X direction.

The respective ink jet heads 46C, 46M, 46Y, and 46K are disposed at regular intervals in the transporting direction of the paper P by being loaded on the carriage. The carriage is provided with a forward-and-backward movement mechanism that individually moves each of the ink jet heads 46C, 46M, 46Y, and 46K forward and backward toward the drawing drum 100. The forward-and-backward movement mechanism is an example of forward-and-backward movement means. By using this forward-and-backward movement mechanism, the distance from the nozzle surface of each of the ink jet heads 46C, 46M, 46Y, and 46K to the peripheral surface of the drawing drum 100 can be adjusted.

The image reader 48 is an example of image reading means, and reads an image for each line from the paper P at a third position set on the transporting path for the paper P. As illustrated in FIG. 2, the image reader 48 is configured to include a line sensor 48A, an imaging lens 48B, and an illumination unit 48C. The line sensor 48A reads an image drawn on the paper P for each line. The line sensor 48A is constituted by, for example, one-dimensional charged coupled device (CCD) image sensor, and one-dimensional complementary metal oxide semiconductor (CMOS) image sensor. The imaging lens 48B reduces an optical image on a reading surface of the paper P to form the reduced optical image on a light-receiving surface of the line sensor 48A. The illumination unit 48C irradiates a region read by the line sensor 48A with illumination light.

The drawing unit 40 is configured as described above. In the process in which the paper P is transported by the drawing drum 100, ink droplets in respective colors of C, M, Y, and K are dropped on the recording surface from the respective ink jet heads 46C, 46M, 46Y, and 46K that constitute the drawing unit 44, and a color image is drawn on the recording surface.

<Ink Drying Unit>

The ink drying unit 50 performs the drying processing of the paper P after the recording. As illustrated in FIG. 1, the ink drying unit 50 is configured to mainly include a chain gripper 52 that transports the paper P, a paper guide 54 that guides traveling of the paper P transported by the chain gripper 52, and a heating and drying device 56 that heats and dries the recording surface of the paper P transported by the chain gripper 52.

The chain gripper 52 receives the paper P from the drawing drum 100, and transports the received paper to the accumulation unit 60. The chain gripper 52 includes an endless chain 52A that travels along a given traveling path, and grips the leading end of the paper P with a gripper 52B provided in the chain 52A to transport the paper P. When being transported by the chain gripper 52, the paper P passes through a heating region and a non-heating region, which are set in the ink drying unit 50, and is transported to the accumulation unit 60. In addition, the heating region is set as a region where the paper P transported from the drawing unit 40 is horizontally transported first, and a non-heating region is set as a region where the paper P is transported in an inclined manner.

The paper guide 54 guides the transportation of the paper P in the heating region and the non-heating region. The paper guide 54 includes a first guide board 54A that guides the transportation of the paper P in the heating region, and a second guide board 54B that guides the transportation of the paper P in the non-heating region. The first guide board 54A and the second guide board 54B have guide surfaces, respectively, and make the paper slide on the guide surfaces to guide the transportation of the paper P. In this case, the first guide board 54A and the second guide board 54B suction the paper P. Accordingly, a tension can be applied to the paper P transported. A negative pressure is used for the suction. The first guide board 54A and the second guide board 54B include a number of suction holes in the guide surfaces, and attract the paper P from the suction holes to suction the paper P thereon.

The heating and drying device 56 is installed in the heating region, and heats the paper P transported through the heating region, to dry the ink applied to the paper P. The heating and drying device 56 is configured to include a plurality of infrared lamps 56A as heat sources, and is disposed inside the chain gripper 52. The infrared lamps 56A are disposed at regular intervals along the transporting path for the paper P in the heating region.

The ink drying unit 50 is configured as described above. The paper P is heated by the heating and drying device 56 and subjected to the drying processing, in the process of being transported by the chain gripper 52.

<Accumulation Unit>

The accumulation unit 60 accumulates the paper P. As illustrated in FIG. 1, the accumulation unit 60 includes an accumulating device 62. The accumulating device 62 receives the paper P from the chain gripper 52, and accumulates the received papery on a tray.

<<Flow of Entire Processing by Ink Jet Recording Device>>

In the ink jet recording device 1 of the present embodiment, the paper P is processed in order of (a) paper feed, (b) coating of processing liquid, (c) drying of processing liquid, (d) recording of image, (e) drying of ink, and (f) accumulation.

First, the paper P is fed from the paper feed unit 10. The paper P fed from the paper feed unit 10 is transported to the processing liquid coating unit 20. Then, the processing liquid is coated on the recording surface in the process of being transported by the processing liquid coating drum 22 of the processing liquid coating unit 20.

Next, the paper P on which the processing liquid is coated is transported to the processing liquid drying unit 30. Then, the paper is subjected to the drying processing in the process of being transported by the processing liquid drying drum 32 of the processing liquid drying unit 30.

Next, the paper P subjected to the drying processing is transported to the drawing unit 40. Then, in the process of being transported by the drawing drum 100 of the drawing unit 40, ink droplets in respective colors of cyan, magenta, yellow, and black are dropped and a color image is recorded.

Next, the paper P on which the image is recorded is transported to the ink drying unit 50. Then, the paper is subjected to the drying processing in the process of being transported by the chain gripper 52 of the ink drying unit 50.

The paper P subjected to the drying processing is transported as it is to the accumulation unit 60 by the chain gripper 52, and is recovered by the accumulating device 62.

<Drawing Drum>

<Configuration of Drawing Drum>

Figure 4:
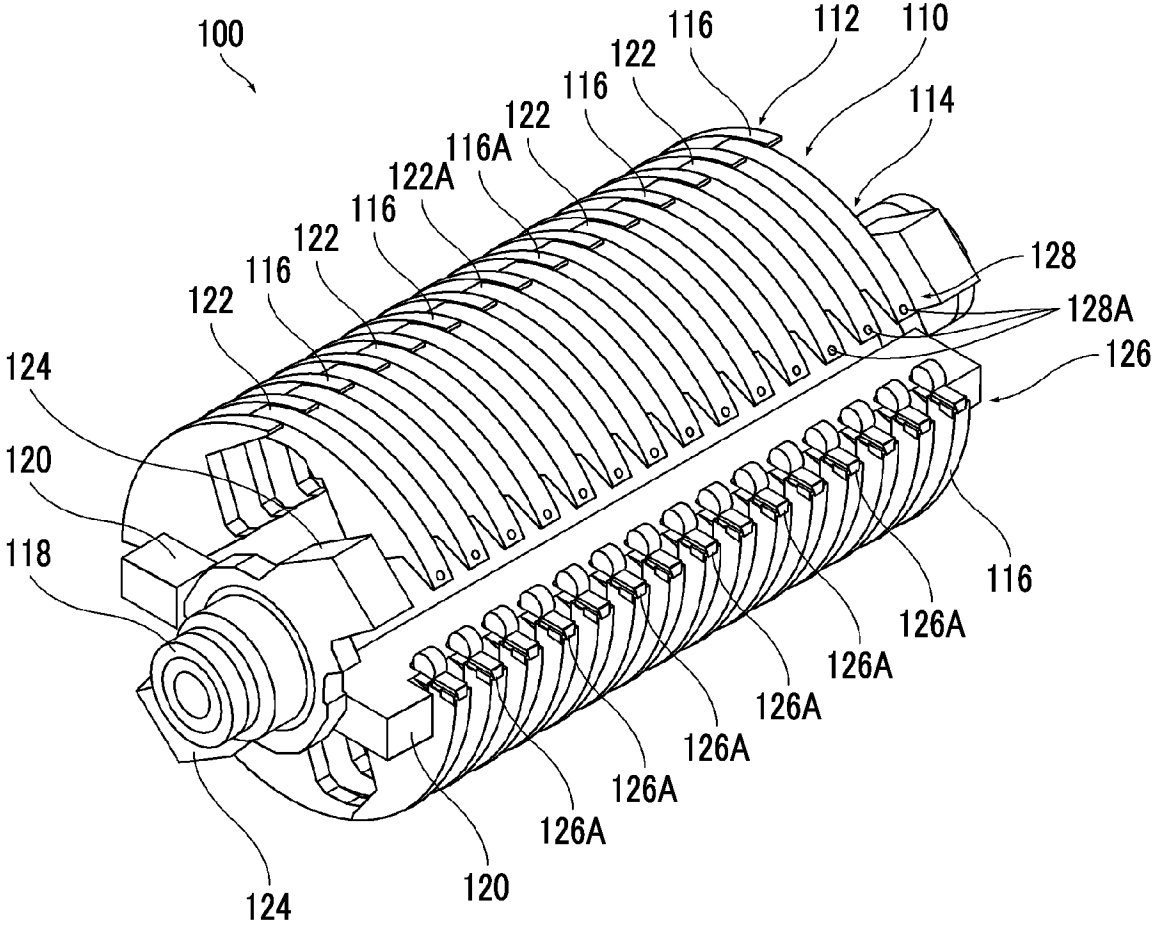
FIG. 4 is a perspective view illustrating a schematic configuration of a drawing drum.
Figure 5:
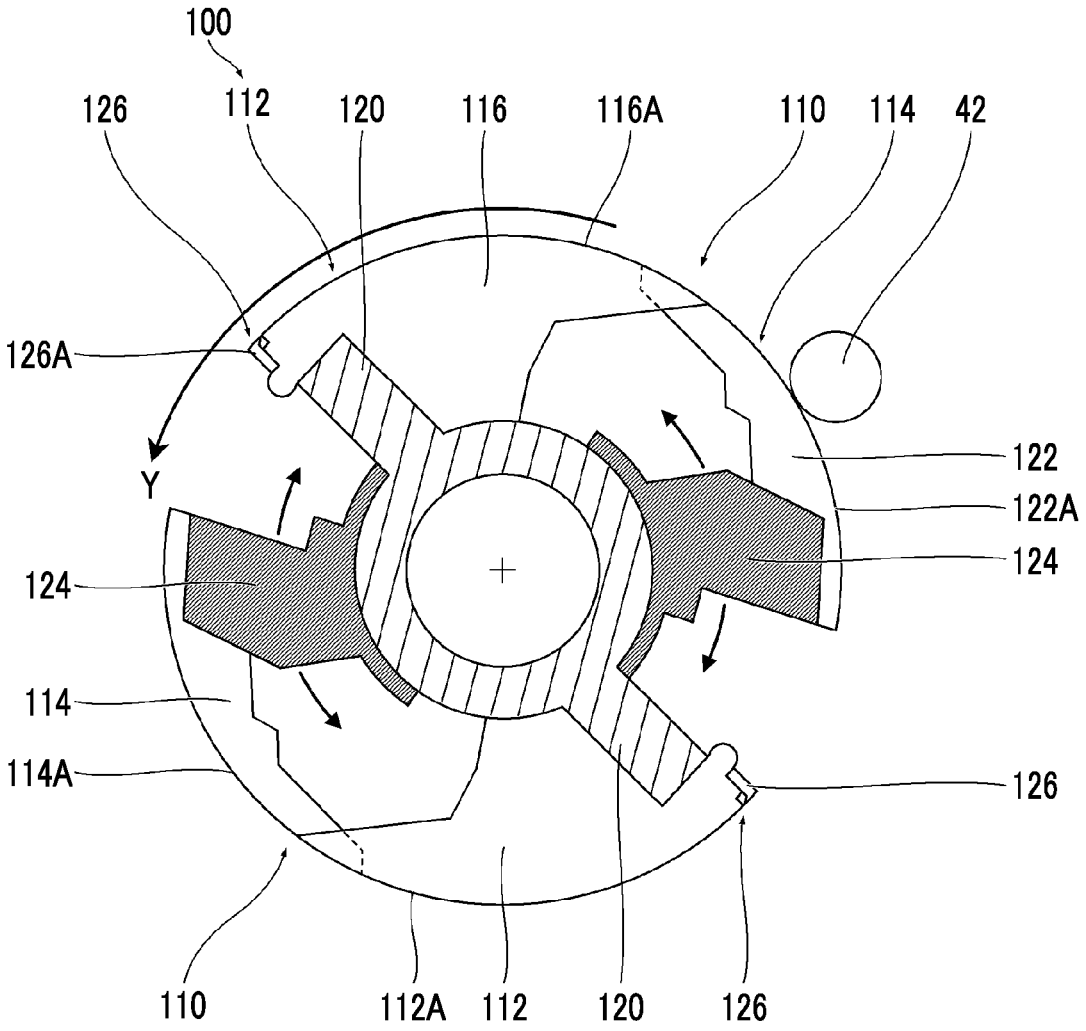
FIG. 5 is a cross-sectional view illustrating a schematic configuration of the drawing drum.

FIG. 4 is a perspective view illustrating a schematic configuration of the drawing drum. Additionally, FIG. 5 is a cross-sectional view illustrating a schematic configuration of the drawing drum.

The drawing drum 100 transports the paper P along the given transporting path by supporting and rotating the paper P with the paper supporting part 110 provided in the outer peripheral part thereof. The drawing drum 100 of the present embodiment includes paper supporting parts 110 in two places of the outer peripheral part.

Figure 6:
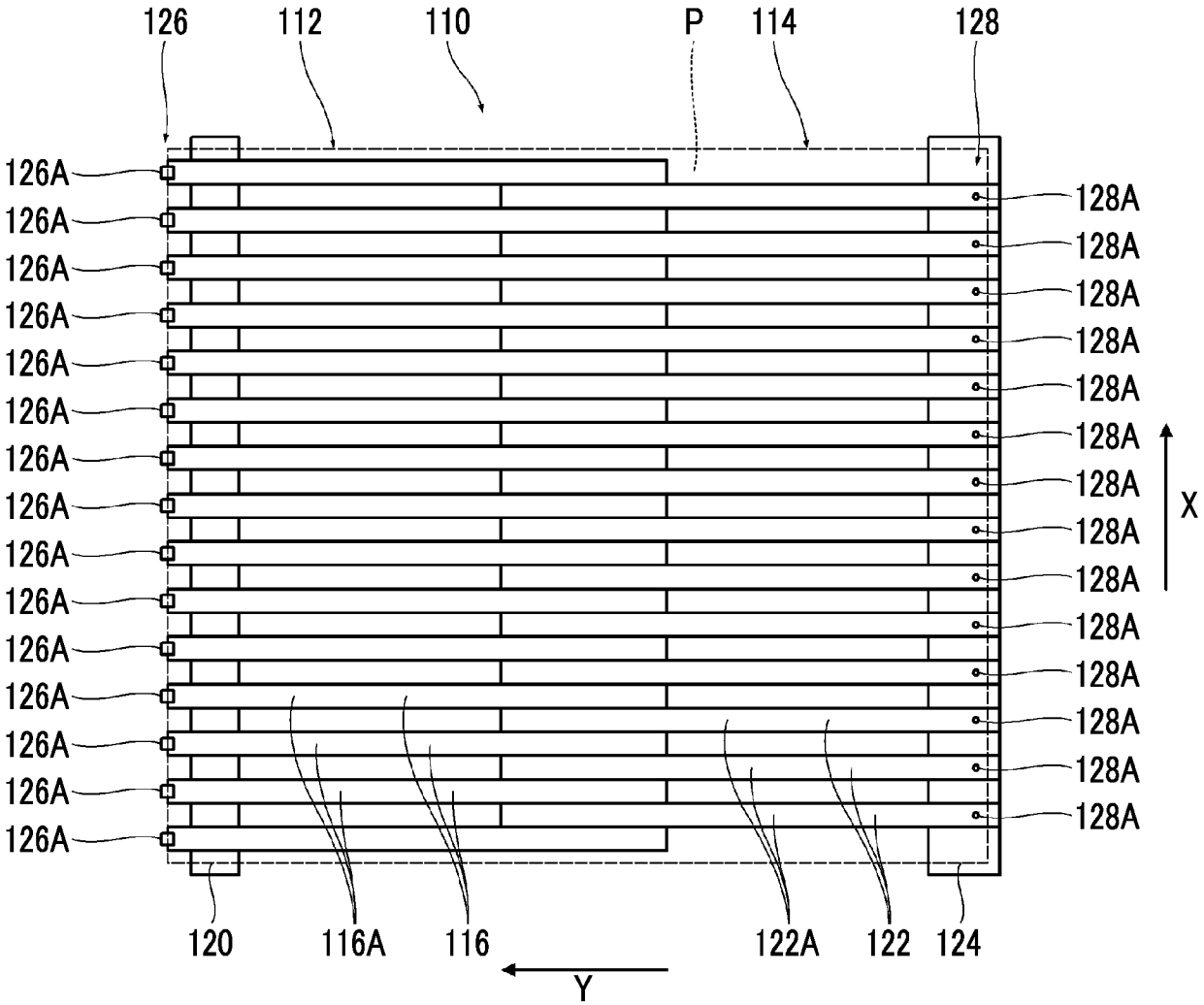
FIG. 6 is a plan developed view of a paper supporting part.

FIG. 6 is a plan developed view of a paper supporting part.

The paper supporting part 110 is constituted by a first support 112 and a second support 114 that have a comb teeth structure, and is configured such that the first support 112 and the second support 114 are engaged with each other and are thereby extendable and retractable.

The first support 112 has a structure in which a plurality of first supporting pieces 116 are arranged in the shape of comb teeth. Each first supporting piece 116 has a plate shape, and has a circular-arc first supporting surface 116A. The first supporting surface 116A functions as a surface that supports the paper P. The first supporting pieces 116 are attached to a first base 120 provided in a rotating shaft 118 of the drawing drum 100 at regular intervals, and are arranged in the shape of comb teeth. The first base 120 is fixed and attached to the rotating shaft 118 of the drawing drum 100. Hence, the first support 112 is fixed and attached to the rotating shaft 118 of the drawing drum 100.

The second support 114 has a structure in which a plurality of second supporting pieces 122 are arranged in the shape of comb teeth. Each second supporting piece 122 has a plate shape, and has a circular-arc second supporting surface 122A. The second supporting surface 122A functions as a surface that supports the paper P. The second supporting pieces 122 are attached to a second base 124 provided in the rotating shaft 118 of the drawing drum 100 at regular intervals, and are arranged in the shape of comb teeth. The second base 124 is attached to be movable with respect to the rotating shaft 118 of the drawing drum 100. Hence, the second support 114 is supported to be movable with the rotating shaft 118 of the drawing drum 100 as a center.

The paper supporting part 110 is increased or reduced in its total length by moving the second support 114. The direction of the increase or reduction is a direction in the transporting direction (Y direction) of the paper P. The drawing drum 100 includes a second support driving mechanism (not illustrated) for moving the second support 114. The paper supporting part 110 is variable in its total length by moving the second support 114 with the second support driving mechanism to change the position of the second support 114.

The paper supporting part 110 includes a gripper 126 that grips the leading end of the paper P, and a suctioning and holding part 128 that suctions and holds a trailing end of the paper P.

The gripper 126 is provided in the first support 112. The gripper 126 has a plurality of grip claws 126A, and grips the leading end of the paper P with the respective grip claws 126A. Each grip claw 126A is provided in each first supporting piece 116.

The suctioning and holding part 128 is provided in the second support 114. The suctioning and holding part 128 suctions and holds the trailing end of the paper P with a negative pressure. A suction hole 128A is provided at rear end part of the second supporting surface 122A of each second supporting piece 122. The suctioning and holding part 128 attracts the paper P from the suction holes 128A, to suction and hold the trailing end of the paper P.

<Working of Drawing Drum>

The drawing drum 100 configured as described above transports the paper P along the given transporting path by supporting and rotating the paper P with the paper supporting part 110. Rotational driving of the drawing drum 100 is performed by a motor (not illustrated).

The paper supporting part 110 grips the leading end of the paper P with the gripper 126 provided in the first supporting pieces 116, and suctions the trailing end of the paper P with the suctioning and holding part 128 provided in the second support 114 to support the paper P. The paper P supported by the paper supporting part 110 has a back surface brought into close contact with the first supporting surface 116A and the second supporting surface 122A.

The paper supporting part 110 is increased or reduced in its total length by moving the second support 114. The total length of the paper supporting part 110 is adjusted according to the size of the paper P to be supported.

<<Configuration of Control System>>

Figure 7:
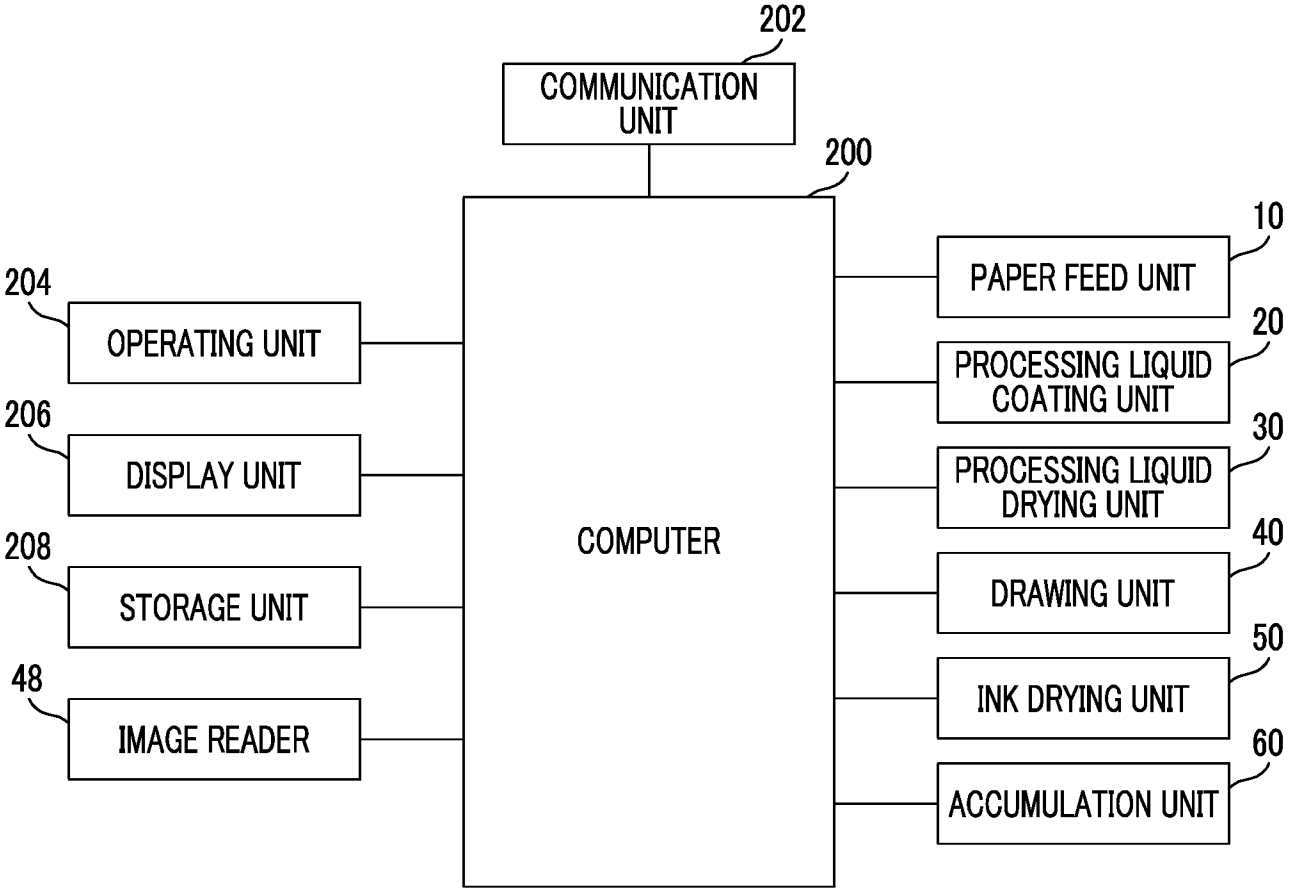
FIG. 7 is a block diagram illustrating a system configuration of a control system of the ink jet recording device.

FIG. 7 is a block diagram illustrating a system configuration of a control system of the ink jet recording device.

As illustrated in this drawing, the overall operation of the ink jet recording device 1 is controlled in an integrated manner by a computer 200. That is, all respective processings, such as the feed of the paper by the paper feed unit 10, the coating of the processing liquid by the processing liquid coating unit 20, the drying of the processing liquid by the processing liquid drying unit 30, the drawing performed by the drawing unit 40, the drying of the ink by the ink drying unit 50, and the accumulation performed by the accumulation unit 60, are controlled by the computer 200.

A communication unit 202 for communicating with an external instrument, an operating unit 204 for operating the ink jet recording device 1, a display unit 206 for displaying various kinds of formation, and a storage unit 208 for storing various kinds of information are connected to the computer 200. Image data of an image recorded on the paper P are input to the computer 200 via the communication unit 202. Additionally, various programs that the computer 200 executes, and various data required for control are stored in the storage unit 208.

Figure 8:
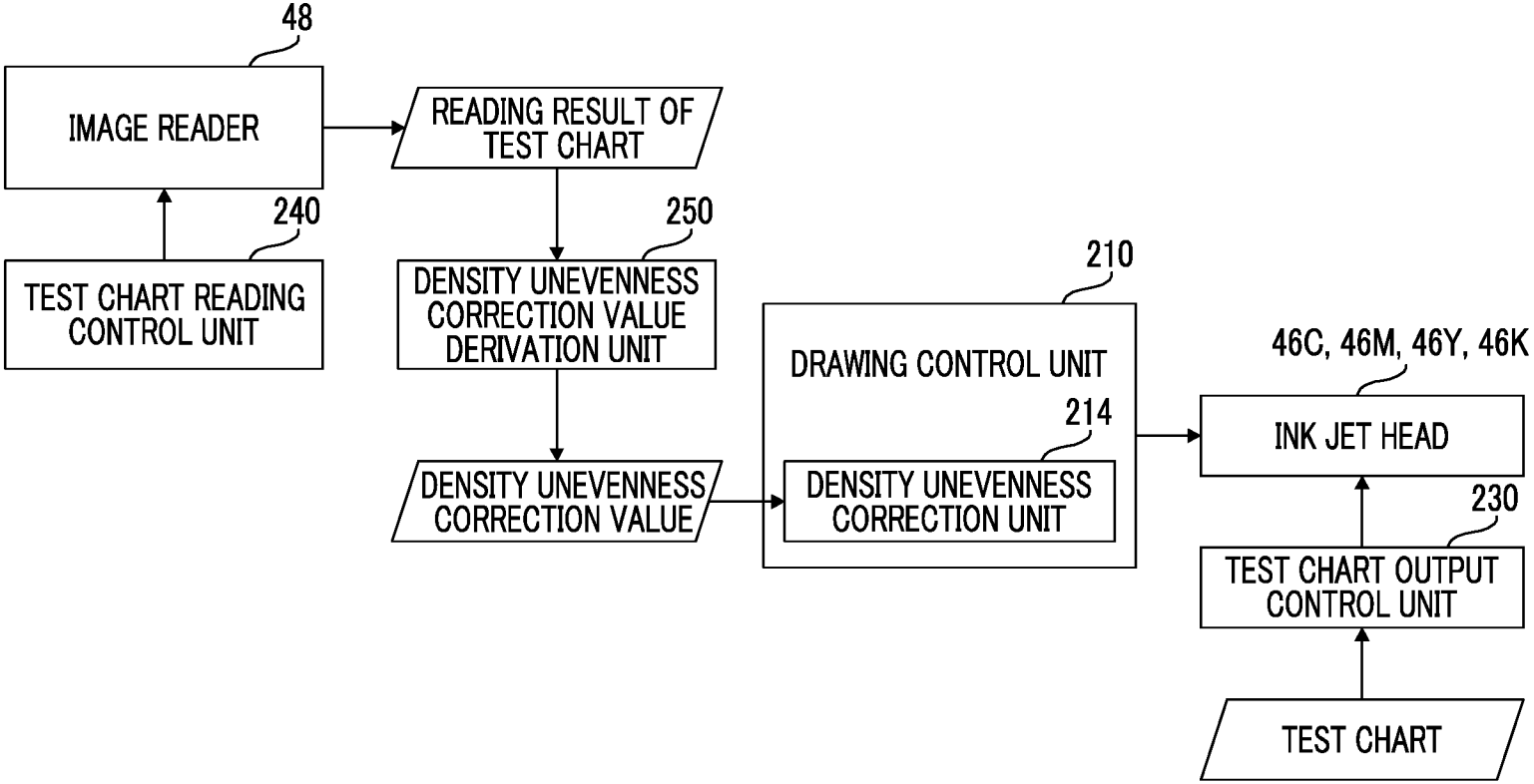
FIG. 8 is a block diagram of mainly functions concerning drawing extracted among various functions realized by a computer.

FIG. 8 is a block diagram of mainly functions concerning drawing extracted among various functions realized by the computer.

As illustrated in FIG. 8, the computer 200 functions as a drawing control unit 210, a test chart output control unit 230, a test chart reading control unit 240, and a density unevenness correction value derivation unit 250, by executing predetermined programs.

<Drawing Control Unit>

Figure 9:
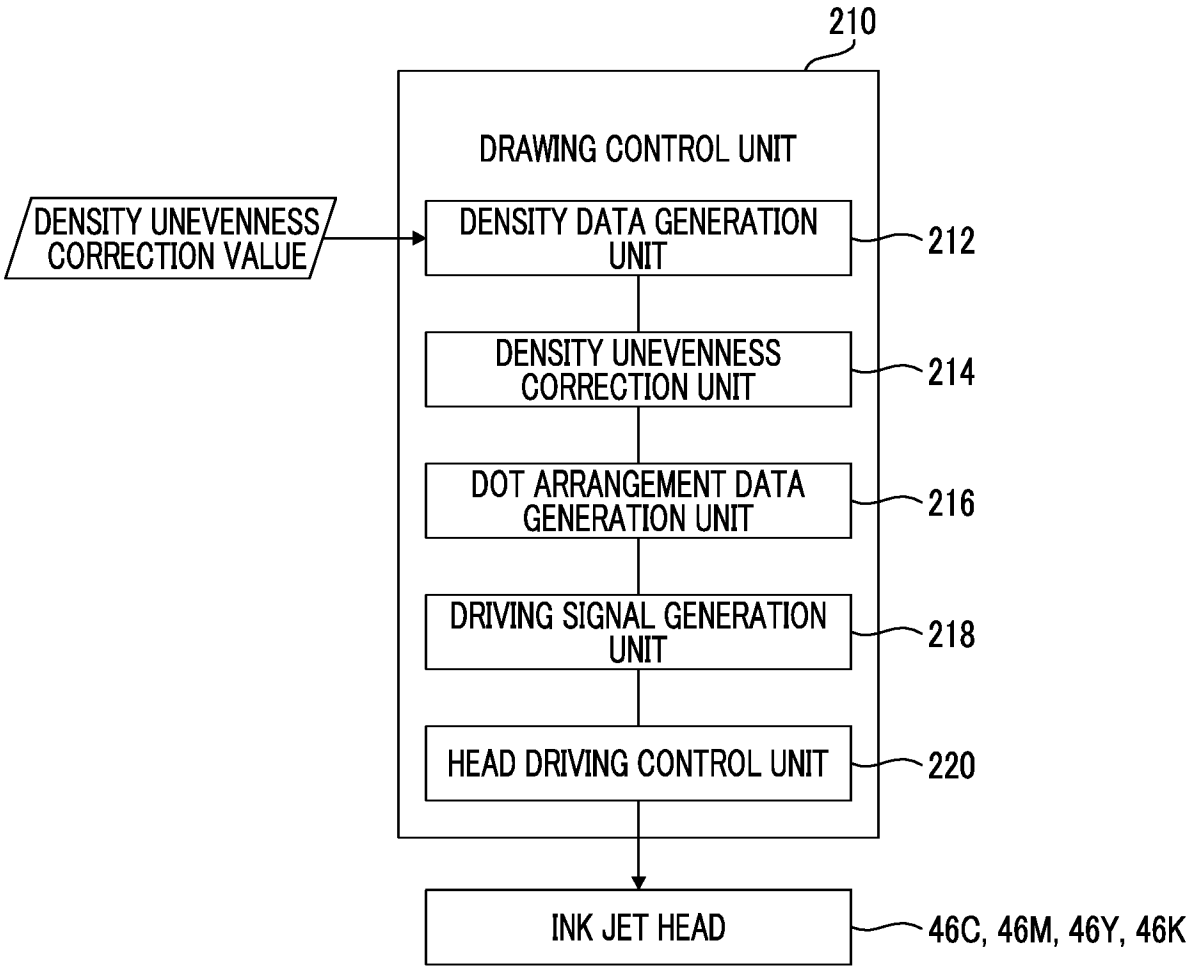
FIG. 9 is a block diagram illustrating a schematic configuration of a drawing control unit.

FIG. 9 is a block diagram illustrating a schematic configuration of the drawing control unit.

The drawing control unit 210 is configured to include a density data generation unit 212 that generates density data from the image data, a density unevenness correction unit 214 that performs density unevenness correction on the density data, a dot arrangement data generation unit 216 that generates dot arrangement data from density data, a driving signal generation unit 218 that generates driving signals for the respective ink jet heads 46C, 46M, 46Y, and 46K from the dot arrangement data, and a head driving control unit 220 that controls driving of the respective ink jet heads 46C, 46M, 46Y, and 46K.

The density data generation unit 212 generates initial density data for each ink color from the image data of the image recorded on the paper P. The density data generation unit 212 fetches the image data of the image recorded on the paper P, and performs predetermined density conversion processing on the fetched image data, to generate the initial density data for each ink color.

The density unevenness correction unit 214 performs density unevenness correction on the density data generated by the density data generation unit 212. The density unevenness correction is the processing performed in order to correct the density unevenness caused when the image is drawn on the paper P, and is performed on the density data for each ink color. The density unevenness correction unit 214 fetches the density data generated by the density data generation unit 212, and performs predetermined density unevenness correction processing on the fetched density data, to correct the density unevenness of the density data. The details of density unevenness correction will be described below.

The dot arrangement data generation unit 216 generates the dot arrangement data from the density data. The dot arrangement data generation unit 216 fetches the density data after the density unevenness correction, and performs predetermined half-toning processing on the fetched density data, to generate the dot arrangement data.

The driving signal generation unit 218 generates the driving signals for the respective ink jet heads 46C, 46M, 46Y, and 46K on the basis of the dot arrangement data generated by the dot arrangement data generation unit 216.

The head driving control unit 220 controls the driving of the respective ink jet heads 46C, 46M, 46Y, and 46K on the basis of the driving signals generated by the driving signal generation unit 218.

<Test Chart Output Control Unit>

The test chart output control unit 230 controls the output of a test chart. The test chart is a test chart for obtaining a correction value of the density unevenness. The details of the test chart will be described below.

The test chart output control unit 230 makes the ink jet heads 46C, 46M, 46Y, and 46K draw the test chart according to output commands for the test chart. Data of the test chart to be output are stored in the storage unit 208. The test chart output control unit 230 reads the data of the test chart from the storage unit 208, to make the ink jet heads 46C, 46M, 46Y, and 46K draw the test chart.

<Test Chart Reading Control Unit>

The test chart reading control unit 240 controls the reading of the test chart. That is, the image reader 48 is made to read an image of the test chart drawn on the paper P according to the output commands for the test chart. The read image data of the test chart are stored in the storage unit 208.

<Density Unevenness Correction Value Derivation Unit>

The density unevenness correction value derivation unit 250 derives the correction value of the density unevenness required for the density unevenness from a reading result of the test chart. The details of a derivation method will be described below. Information on the derived density unevenness correction value is stored in the storage unit 208.

The density unevenness correction unit 214 corrects the density unevenness of the density data using the information on the density unevenness correction value derived by the density unevenness correction value derivation unit 250.

<<Density Unevenness Correction Method>>

<Outline of Density Unevenness Correction>

First, a general density unevenness correction method will be outlined. Generally, the correction of the density unevenness is carried out in a following sequence.

Figure 10:
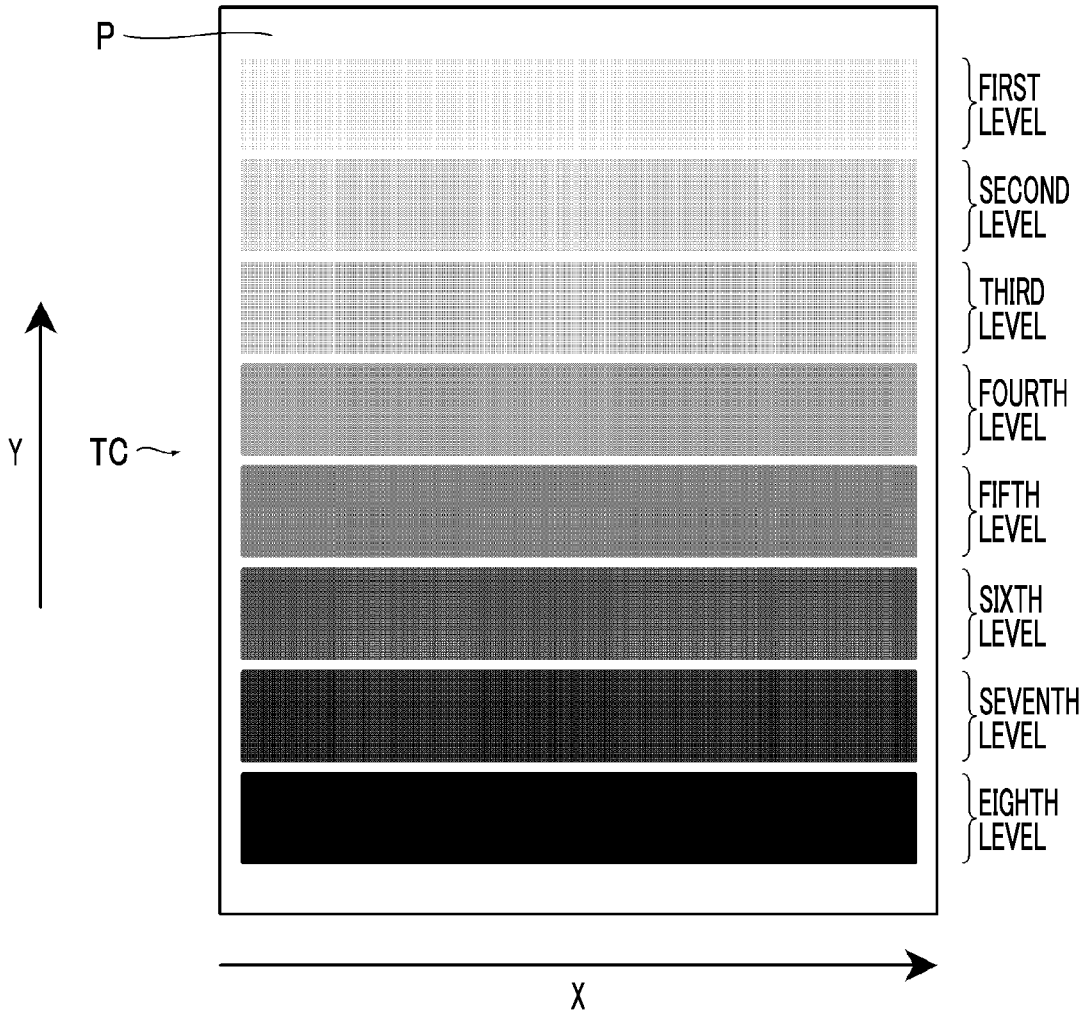
FIG. 10 is a plan view illustrating an example of a test chart used for general density unevenness correction.

First, a test chart TC including a plurality of grayscales is output to the paper P. FIG. 10 is a plan view illustrating an example of a test chart used for general density unevenness correction. As illustrated in this drawing, a chart in which density varies at multiple levels is used as the test chart TC used for the general density unevenness correction. In addition, in this drawing, the symbol Y represents the transporting direction of the paper P. Additionally, the symbol X represents an arrangement direction of the nozzles.

One test chart TC is output for each color. That is, the test chart is output for each of the ink jet heads 46C, 46M, and 46Y and 46K.

Additionally, the test chart TC is output by ink droplets being discharged from all the nozzles to be used at the time of image drawing. In the case of the line-type ink jet heads, the nozzles to be used vary according to the size of paper. For example, in a case where drawing is performed on a small size of paper, only nozzles in a partial region are used. Hence, the test chart TC is output by ink droplets being discharged from nozzles in a region corresponding to the size of the paper to be used.

Next, the image of the test chart output to the paper P is read by the image reader.

Next, the read image data of the test chart are analyzed, and a correction value of density unevenness is obtained for each grayscale with respect to all the nozzles to be used such that the density data of each grayscale become uniform in the arrangement direction of the nozzles.

Figure 11:
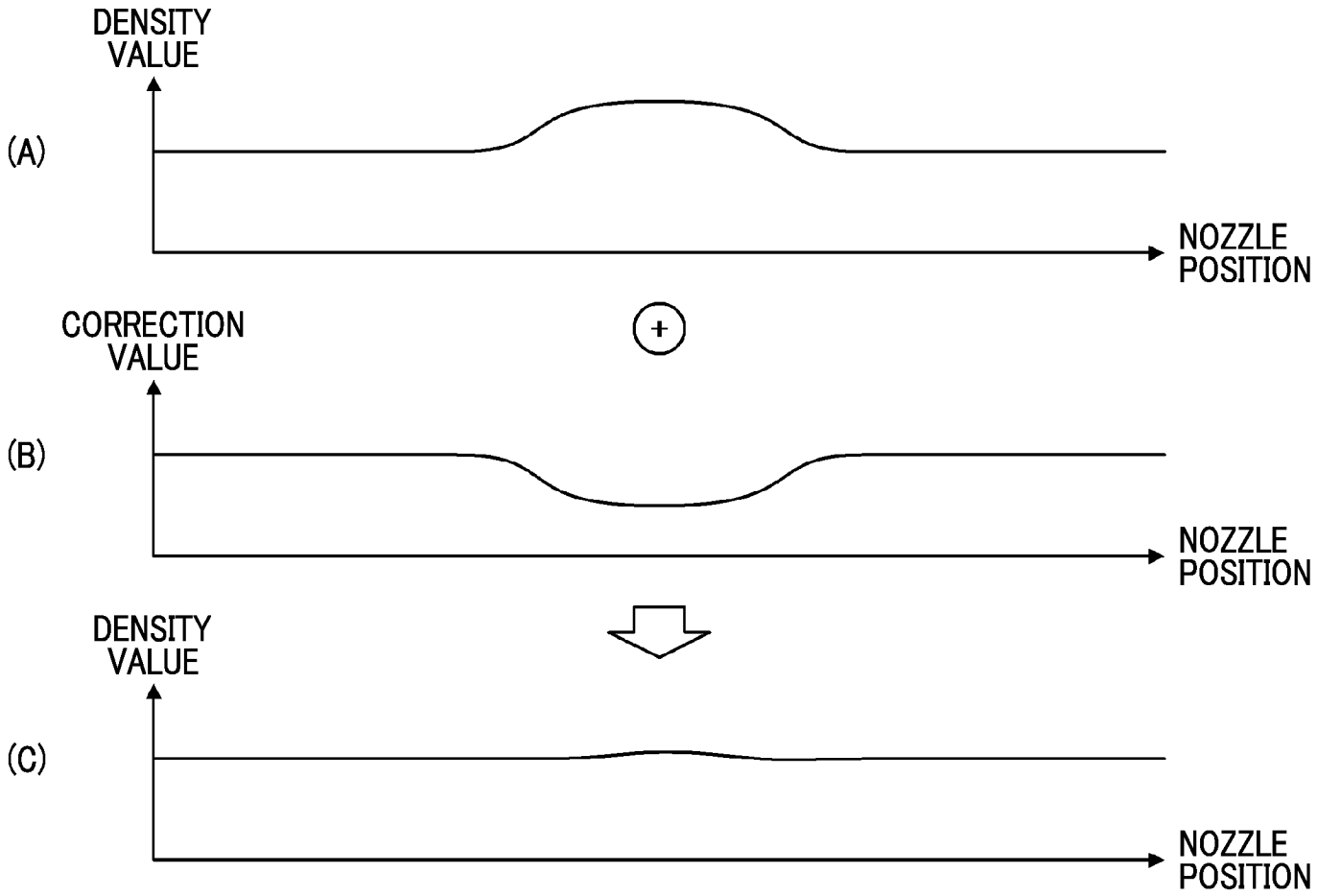
FIG. 11 is a conceptual diagram of derivation of a correction value of density unevenness.

FIG. 11 is a conceptual diagram of the derivation of the correction value of the density unevenness.

FIG. 11(A) is a view illustrating a reading result of a certain grayscale. In this drawing, a horizontal axis represents positions in the arrangement direction of the nozzles, and a vertical axis represents values read by the image reader. The reading values are synonymous with density values.

FIG. 11(B) is a view illustrating an example of a correction value of the density unevenness obtained from the reading result of FIG. 11(A). In this drawing, a horizontal axis represents positions in the arrangement direction of the nozzles, and a vertical axis vertical axis represents the correction value of the density unevenness. As illustrated in this drawing, the correction value of the density unevenness is obtained such that the density value becomes uniform in the arrangement direction of the nozzles.

The correction value of the density unevenness is obtained for each grayscale. In a case where a reading result of a grayscale intended to obtain is not present, complementation is performed using a reading result of another grayscale. For example, in FIG. 10, a correction value of the density unevenness of a grayscale between a seventh level and an eighth level is obtained using a reading result at the seventh level, the eighth level, or the like that is a reading result.

The density data are corrected using information on the correction value of the density unevenness obtained as described above. That is, the density data are corrected by adding the correction value to the density data. Accordingly, an image with a uniform density can be output in the arrangement direction of the nozzles in each grayscale.

FIG. 11(C) is a view illustrating a reading result of an output image after the correction of the density unevenness. As illustrated in this drawing, output can be performed with a substantially uniform density in the arrangement direction of the nozzles by performing the density unevenness correction.

<Density Unevenness Correction Method in Ink Jet Recording Device of Present Embodiment>

As described above, in the ink jet recording devices 1 of the present embodiment, the paper supporting part 110 of the drawing drum 100 is configured such that the first support 112 and the second support 114 that have the comb teeth structure are engaged with each other and are extendable and retractable. If the paper P is supported by the paper supporting part 110 having such a structure, a region supported in contact with a support and a region supported without contacting a support are generated in the paper P.

Figure 12:
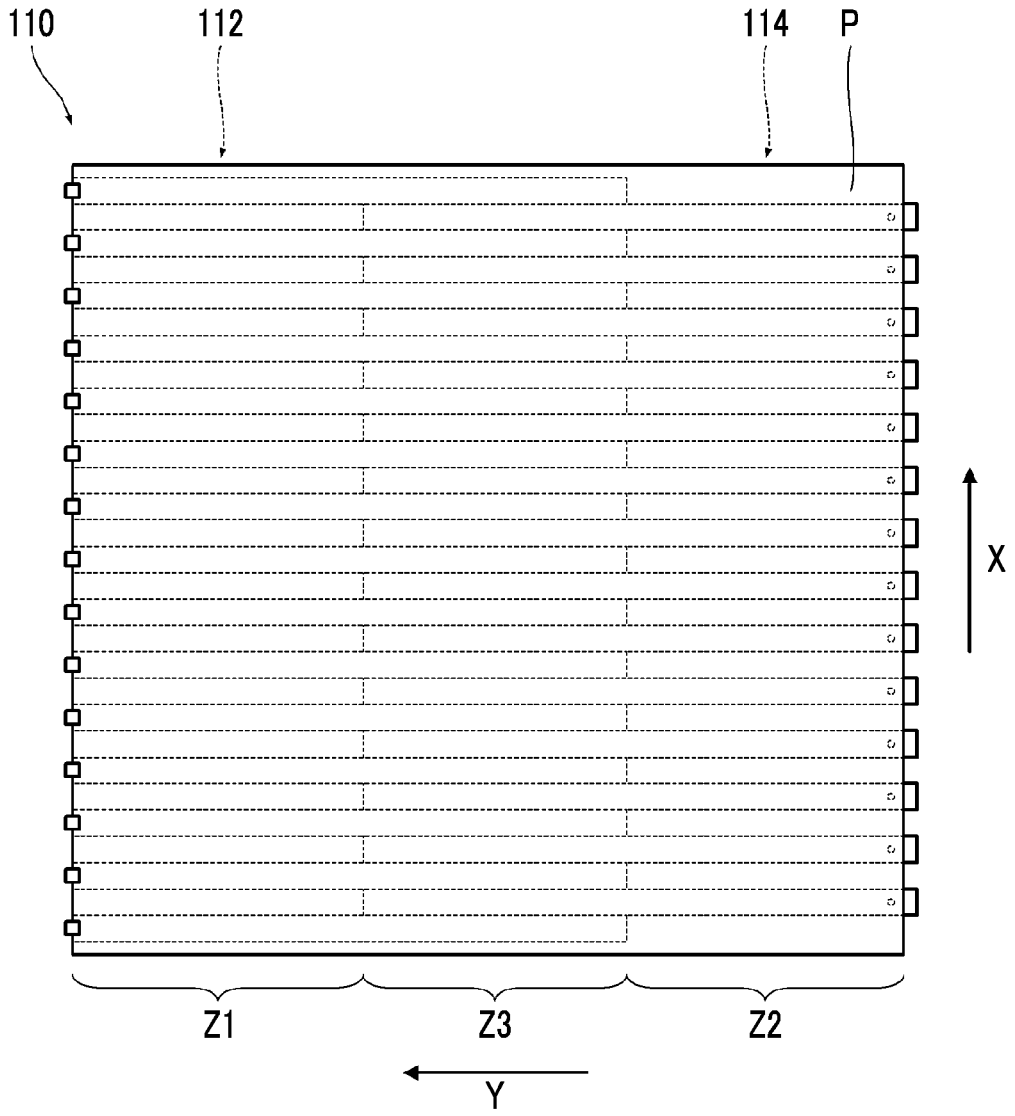
FIG. 12 is a plan developed view illustrating a supported state of paper by the paper supporting part.

FIG. 12 is a plan developed view illustrating a supported state of the paper by the paper supporting part.

As illustrated in FIG. 12, a region supported only by the first support 112, a region supported only by the second support 114, a region supported by both of the first support 112 and the second support 114 are generated in the paper P. Also, a region supported in contact with a support and a region supported without contacting a support are generated in the region supported only by the first support 112 and the region supported only by the second support 114.

In this way, if the region supported in contact with a support and the region supported without contacting a support are present in the paper P, density unevenness occurs in a case where the temperature of the paper P is different from the temperature of the supports.

Although the density unevenness can be corrected by performing the above-described density unevenness correction, the following problems occur if the density unevenness correction method that is generally performed is applied as it is.

[Problems in Case where Density Unevenness Correction is Corrected by General Method]

Figure 13:
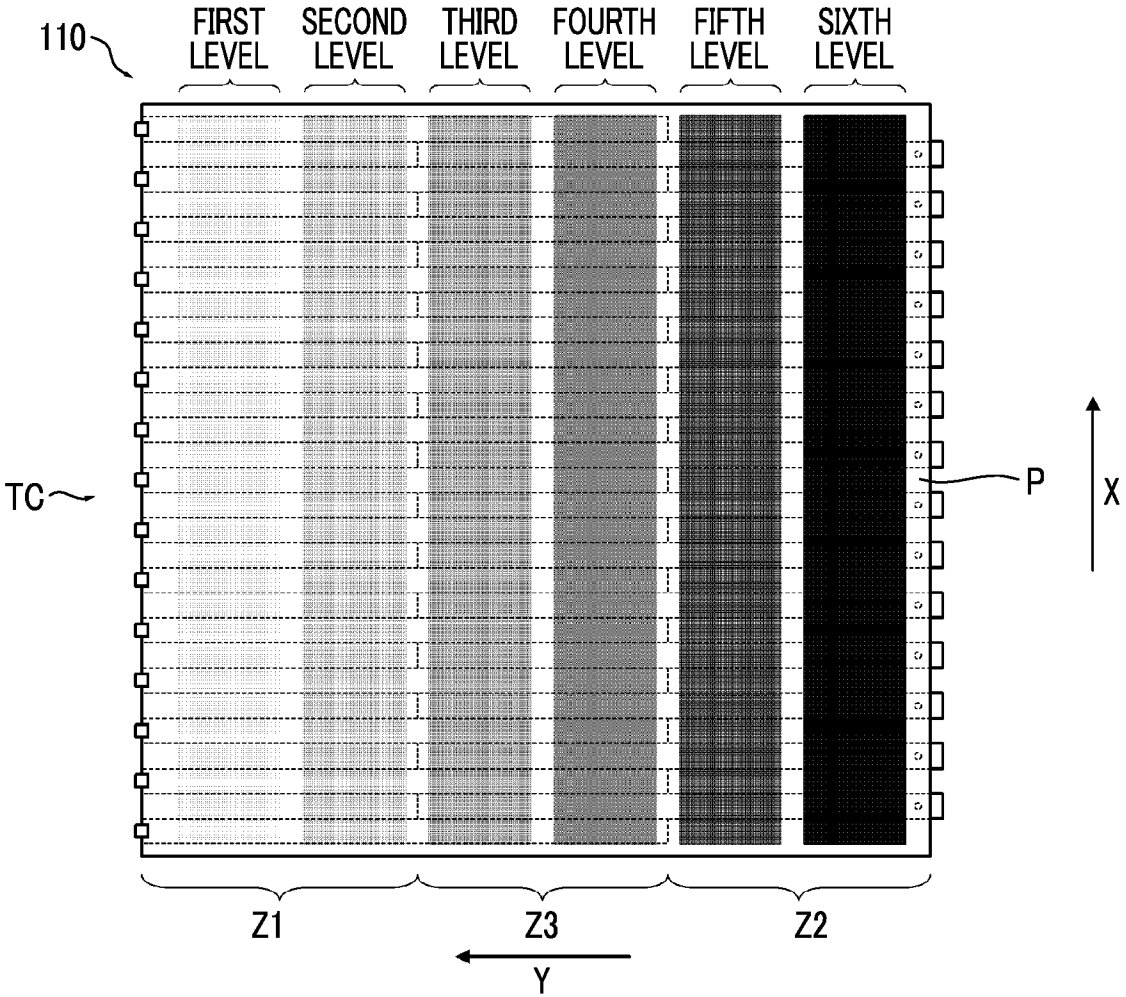
FIG. 13 is a view illustrating an example output of a test chart for the density unevenness correction in a case where the density unevenness correction is performed by a general method.

FIG. 13 is a view illustrating an example output of a test chart for the density unevenness correction in a case where the density unevenness correction is performed by the general method.

A test chart TC has a structure in which images of a plurality of grayscales are lined up in the transporting direction (Y direction) of the paper P. An image of each grayscale is constituted by a beltlike image that extends in the arrangement direction (X direction) of the nozzles. FIG. 13 illustrates an example of the test chart TC including six grayscales. In this case, six beltlike images of which the grayscales vary at six levels are drawn in the transporting direction of the paper P. As for the images of the respective grayscales, a first level image has the thinnest grayscale, a sixth level image has the deepest grayscale, and the grayscales vary stepwisely from the first level image toward the sixth level image.

Now, in a case where the paper P is supported by the paper supporting part 110, a region where the paper P is supported by only the first support 112 is defined as a first region Z1, a region where the paper P is supported by only the second support 114 is defined as a second region Z2, and a region where the paper P is supported by the first support 112 and the second support 114 is defined as a third region Z3.

In addition, both of a region where the paper is supported in close contact with the first supporting pieces 116, a region where the paper is supported without being in close contact with the first supporting pieces 116, that is, a region where the paper is supported in the state of floating between the first supporting pieces 116 adjacent to each other are included in the first region Z1. Similarly, both of a region where the paper is supported in close contact with the second supporting pieces 122, and a region where the paper is supported without being in close contact with the second supporting pieces 122 are also included in the second region Z2. The third region Z3 is a region where the second supporting pieces 122 of the second support 114 are engaged with the first supporting pieces 116 of the first support 112. In this third region Z3, a substantially whole surface of the paper P is supported in close contact with the first supporting pieces 116 or the second supporting pieces 122.

In the test chart TC, the first level image and a second level image are drawn in the first region Z1, a third level image and a fourth level image are drawn in the third region Z3, and, a fifth level image and the sixth level image are drawn in the second region Z2.

Figure 14:
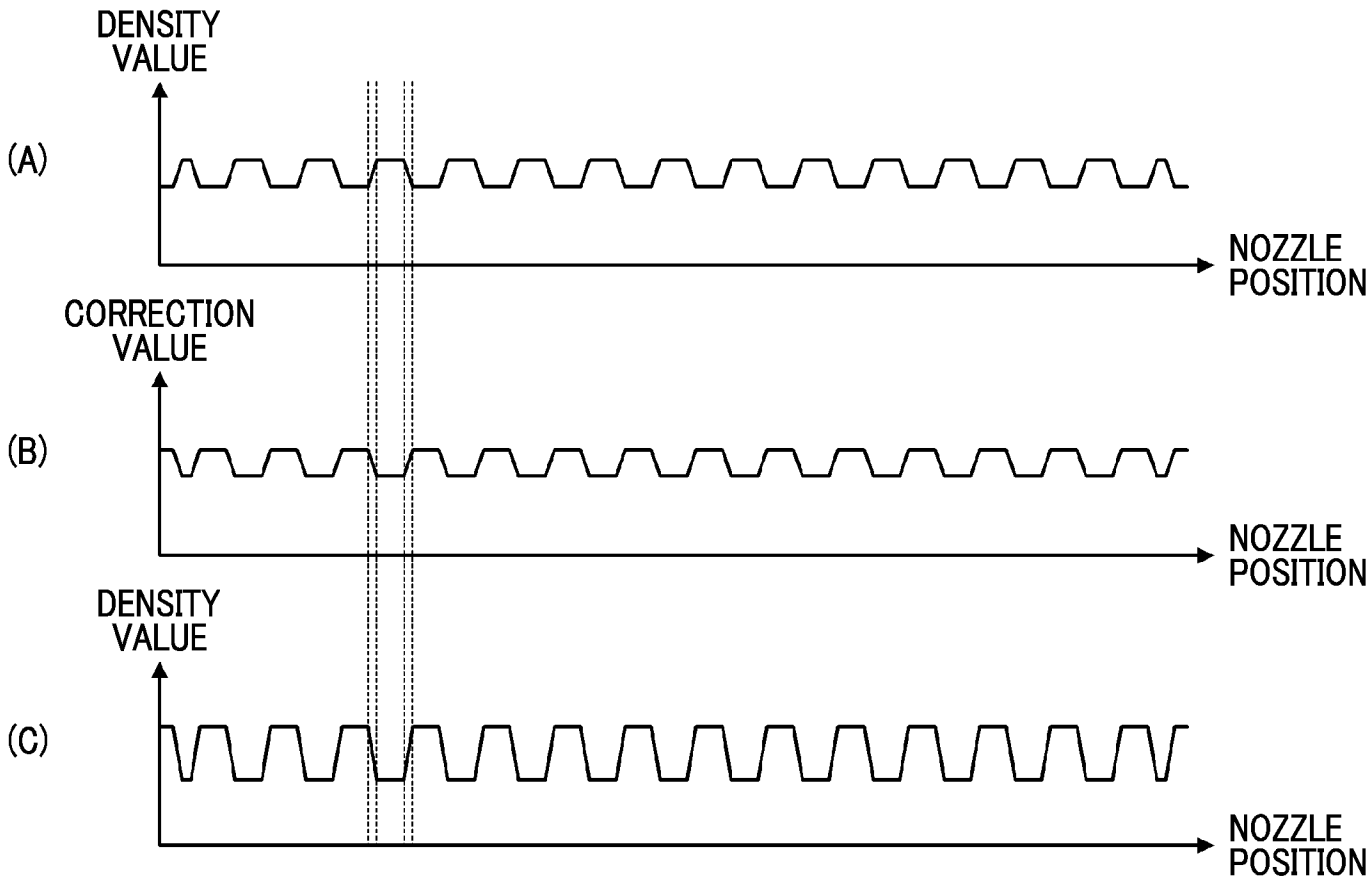
FIG. 14 is an explanatory view in a case where the density unevenness is corrected by the general method.

FIG. 14 is an explanatory view in a case where the density unevenness is corrected by the general method.

FIG. 14(A) is a view illustrating a reading result of the second level image of the test chart. In this drawing, a horizontal axis represents positions in the arrangement direction of the nozzles, and a vertical axis represents values read by the image reader. The reading values are synonymous with density values.

In addition, in the present example, in order to simplify description, it is supposed that there is no density unevenness originating from the ink jet heads. Additionally, it is supposed that the temperature of the paper supporting part 110 is higher than the temperature of the paper P before being supported in the paper supporting part 110. In this case, when the paper P is supported by the paper supporting part 110, the temperature of the region supported in contact with a support becomes high. Additionally, it is supposed that, as the temperature is lower, the density of an image to be drawn is lower. Hence, the density of the region supported in contact with a support becomes lower than the density of the region supported without contacting a support.

The second level image of the test chart is drawn in the first region Z1 of the paper P. In the first region Z1, the region supported in contact with the first supporting pieces 116 of the first support 112, and the region supported without contacting the first supporting pieces 116 appear alternately. As a result, as illustrated in FIG. 14(A), reading values of the second level image of the test chart vary periodically.

FIG. 14(B) is a view illustrating an example of a correction value of the density unevenness obtained from the reading result of the second level image of the test chart.

The density of the region supported without contacting a support becomes higher than the density of the region supported in contact with a support. Hence, the correction value is obtained such that the density of the region supported in contact with a support becomes high.

Now, a case where an image solid-coated on the whole surface of the paper P in the density of the second level image of the test chart is output is considered.

In this case, if the correction of the density unevenness is performed using the correction value of the density unevenness obtained from the reading result of the second level image of the test chart, an excellent output result without density unevenness is obtained in the first region Z1.

However, since the appearance way of the density unevenness in the second region Z2 and the third region Z3 is different from that in the first region Z1, the density unevenness is rather promoted.

FIG. 14(C) is a view illustrating a reading result in the second region. In the second region Z2, the appearance way of the region where the paper P is supported in contact with a support and the region where the paper is supported without contacting support becomes reverse to the first region Z1. As a result, if the density unevenness is corrected with the correction value of the density unevenness obtained from the reading result of the test chart drawn in the first region Z1, as illustrated in FIG. 14(C), an image in which the density unevenness is promoted is output.

[Density Unevenness Correction Method in Ink Jet Recording Device of Present Embodiment]

Next, the density unevenness correction method in the ink jet recording device 1 of the present embodiment will be described.

In the ink jet recording device 1 of the present embodiment, the correction value of the density unevenness is obtained for each region, and the density unevenness correction is carried out for each region. That is, the correction value of the density unevenness in the first region Z1, the correction value of the density unevenness in the second region Z2, and the correction value of the density unevenness in the third region Z3 are obtained individually, and the density unevenness correction is performed for each region on the basis of the obtained correction value of the density unevenness for each region.

The correction of the density unevenness includes respective steps of (1) a test chart output step of outputting a test chart, (2) a test chart read step of reading an image of the output test chart, (3) a density unevenness correction value derivation step of deriving a correction value of density unevenness for each region from a reading result of the test chart, and (4) a density unevenness correction step of performing density unevenness correction for each region on the basis of the obtained correction value of the density unevenness for each region.

(1) Test Chart Output Step

The test chart output step is a step of outputting a test chart.

Figure 15:
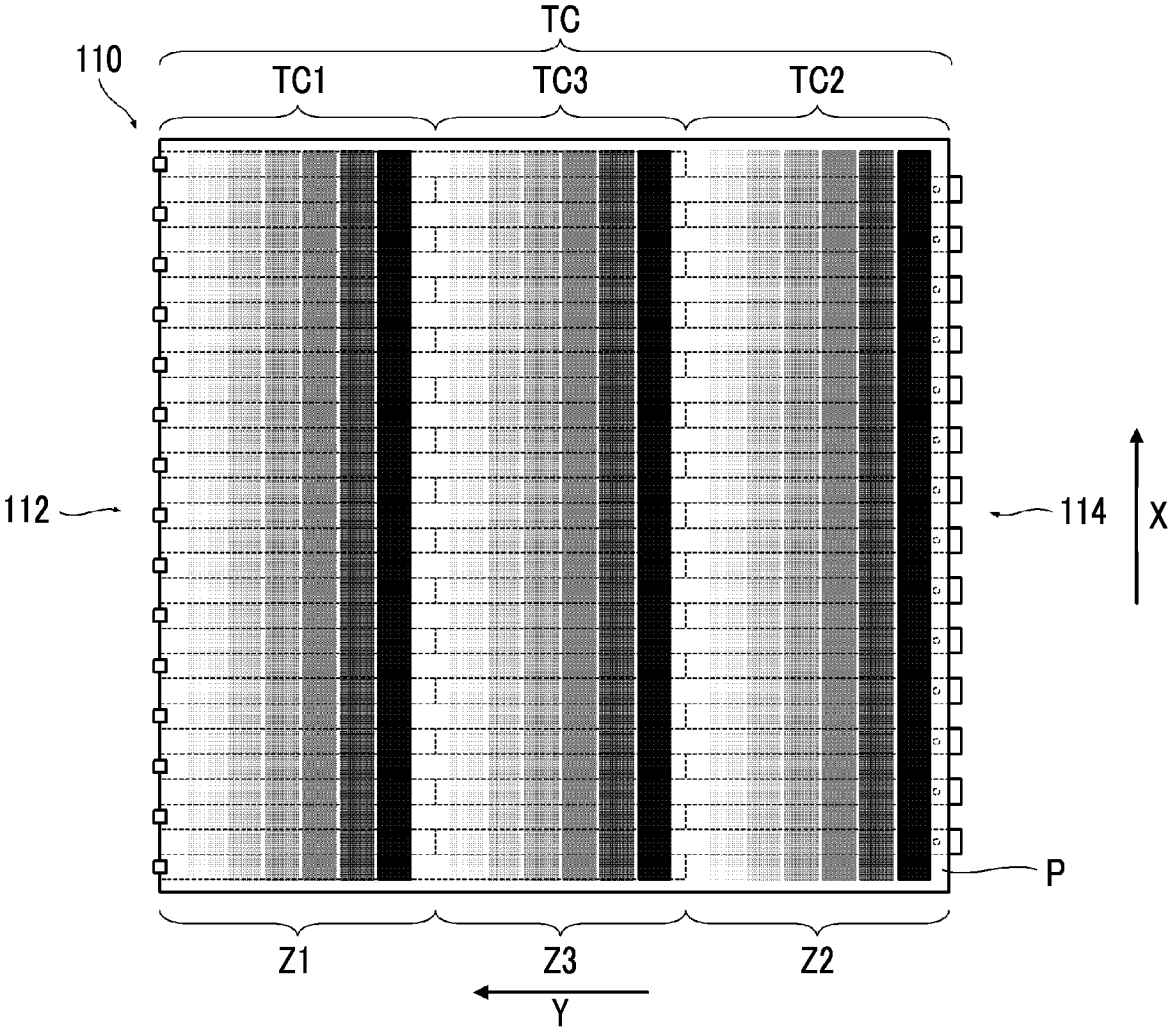
FIG. 15 is a plan view illustrating an example of a test chart to be used for the density unevenness correction.

FIG. 15 is a plan view illustrating an example of a test chart to be used for the density unevenness correction.

A test chart TC includes a first chart TC1 to be drawn in the first region Z1, a second chart TC2 to be drawn in the second region Z2, and a third chart TC3 to be drawn in the third region Z3. The configurations of the respective charts are the same. Additionally, the configurations of the respective charts are the same as the configuration of a test chart to be used for ordinary density unevenness correction, and are configurations including a plurality of grayscales. That is, the test chart TC to be used for the density unevenness correction of the present embodiment is configured such that the test chart to be used for the ordinary density unevenness correction is drawn for each region.

The test chart output control unit 230 makes the ink jet heads 46C, 46M, 46Y, and 46K draw the test chart TC illustrated in FIG. 15 according to output commands for the test chart.

(2) Test Chart Read Step

The test chart read step is a step of reading an image of the output test chart TC.

The test chart reading control unit 240 makes the image reader 48 read the image of the test chart TC drawn on the paper P. The read image data of the test chart TC are stored in the storage unit 208.

(3) Density Unevenness Correction Value Derivation Step

The density unevenness correction value derivation step is a step of obtaining a correction value of density unevenness for each region from a reading result of the test chart TC. Here if a correction value of density unevenness in the first region is defined as a first density unevenness correction value, a correction value of density unevenness in the second region is defined as a second density unevenness correction value, and a correction value of density unevenness in the third region is defined as a third density unevenness correction value, the first density unevenness correction value is obtained from a reading result of the first chart, the second density unevenness correction value is obtained from a reading result of the second chart, and the third density unevenness correction value is obtained from a reading result of the third chart.

The density unevenness correction value derivation unit 250 derives a density unevenness correction value of each region from the reading result of the test chart.

Figure 16:
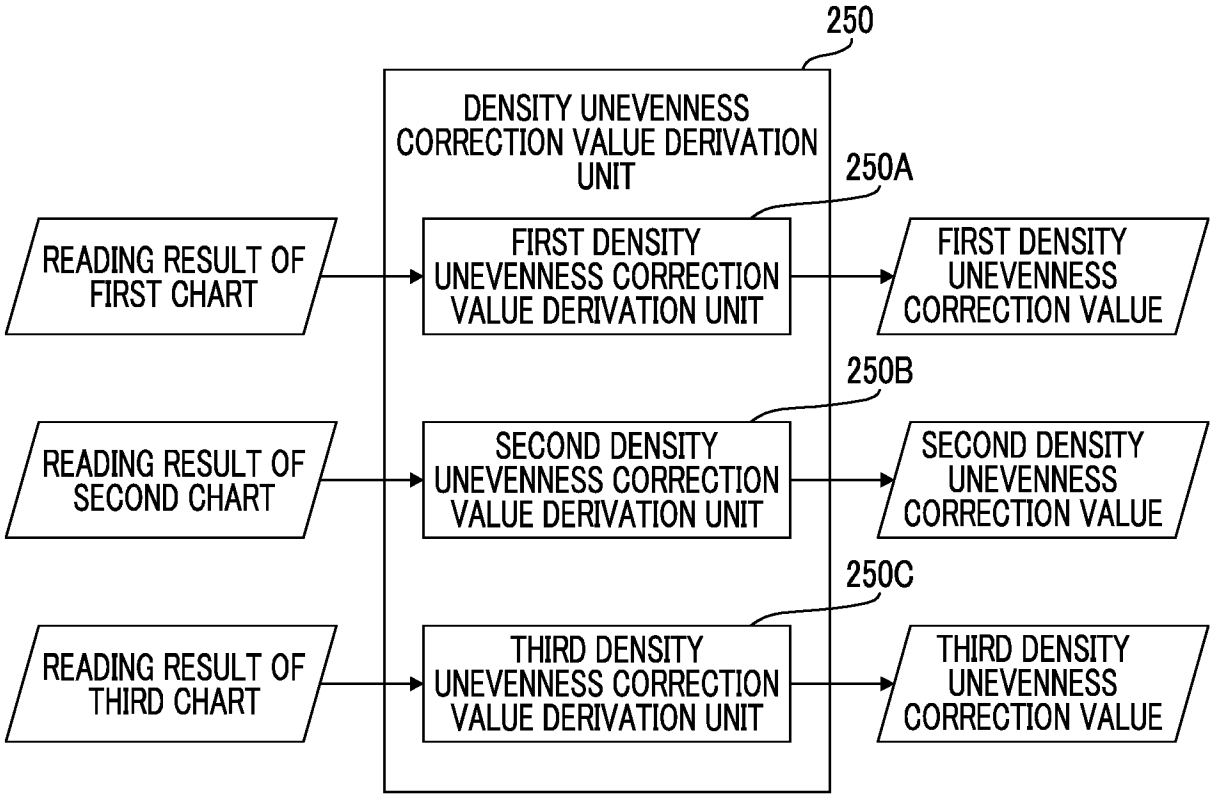
FIG. 16 is a block diagram illustrating the configuration of a density unevenness correction value derivation unit.

FIG. 16 is a block diagram illustrating the configuration of the density unevenness correction value derivation unit.

The density unevenness correction value derivation unit 250 includes a first density unevenness correction value derivation unit 250A, a second density unevenness correction value derivation unit 250B, and a third density unevenness correction value derivation unit 250C.

The first density unevenness correction value derivation unit 250A derives the first density unevenness correction value from the reading result of the first chart TC1 within the test chart TC.

The second density unevenness correction value derivation unit 250B derives the second density unevenness correction value from the reading result of the second chart TC2 within the test chart TC.

The third density unevenness correction value derivation unit 250C derives the third density unevenness correction value from the reading result of the third chart TC3 within the test chart TC.

In addition, a method of deriving the correction value of the density unevenness of each region is the same as a method of deriving correction value of density unevenness that is generally performed. That is, image data of a test chart of each region is analyzed, and a correction value of density unevenness is obtained for each grayscale with respect to all the nozzles to be used such that density data of each grayscale become uniform in the arrangement direction of the nozzles.

Information on the obtained correction value of the density unevenness of each region is stored in the storage unit 208.

(4) Density Unevenness Correction Step

The density unevenness correction step is a step of performing density unevenness correction for each region on the basis of the obtained correction value of the density unevenness for each region. The density unevenness correction is carried out on the density data generated by the density data generation unit 212.

The density unevenness correction unit 214 carries out the density unevenness correction of the density data generated by the density data generation unit 212 for each region.

That is, density unevenness correction is carried out with the first density unevenness correction value regarding a portion belonging to the first region Z1 among the images to be drawn on the paper P, density unevenness correction is carried out with the second density unevenness correction value regarding a portion belonging to the second region Z2, and density unevenness correction is carried out with the third density unevenness correction value regarding a portion belonging to the third region Z3.

In this case, if the density unevenness correction value is defined as C, C can be expressed as follows.

$$C(d,x,k)$$

Here, d represents a density value, x represents a position in the arrangement direction of the nozzles, and k represents a region. The region k is any of the first region Z1, the second region Z2, and the third region Z3. The first region Z1 is defined as k=k1, the second region Z2 is defined as k=k2, and the third region Z3 is defined as k=k3. Hence, the first density unevenness correction value that is the correction value of the density unevenness in the first region Z1 can be expressed as C(d, x, k1), and the second density unevenness correction value that is the correction value of the density unevenness in the second region Z2 can be expressed as C(d, x, k2). Additionally, the third density unevenness correction value that is the correction value of the density unevenness in the third region Z3 can be expressed as C(d, x, k3).

<<Processing from Image Input to Drawing>>

Figure 17:
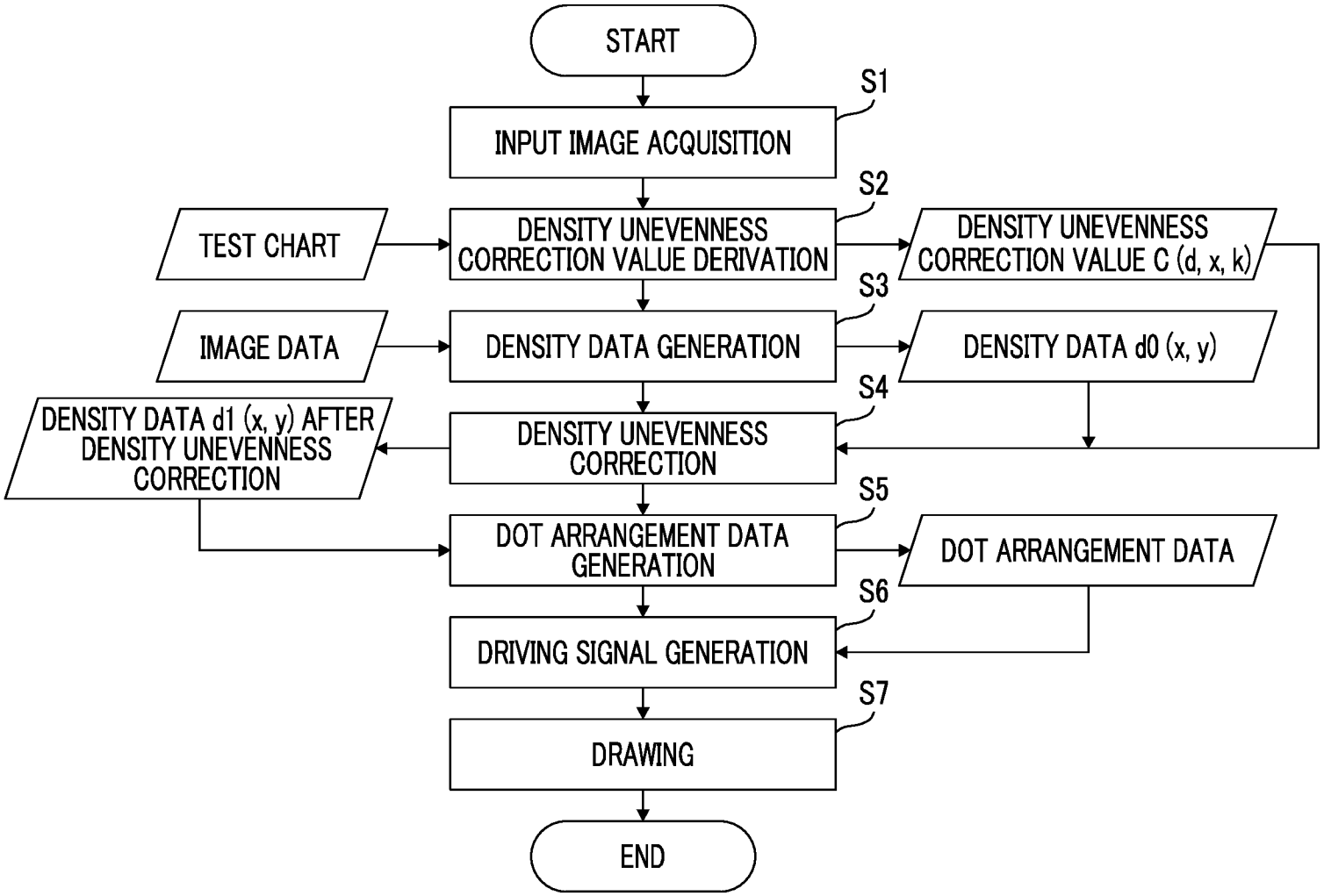
FIG. 17 is a flowchart illustrating a procedure of a series of processing from the input of an image to the output thereof.

FIG. 17 is a flowchart illustrating a procedure of a series of processing from the input of an image to the output thereof First, image data of an image to be drawn on the paper P is acquired (Step S1). The image data are input to the computer 200 via the communication unit 202.

Next, derivation processing of density unevenness correction value is carried out (Step S2). That is, the processing of deriving the first density unevenness correction value, the second density unevenness correction value, and the third density unevenness correction value required for the density unevenness correction is carried out.

Figure 18:
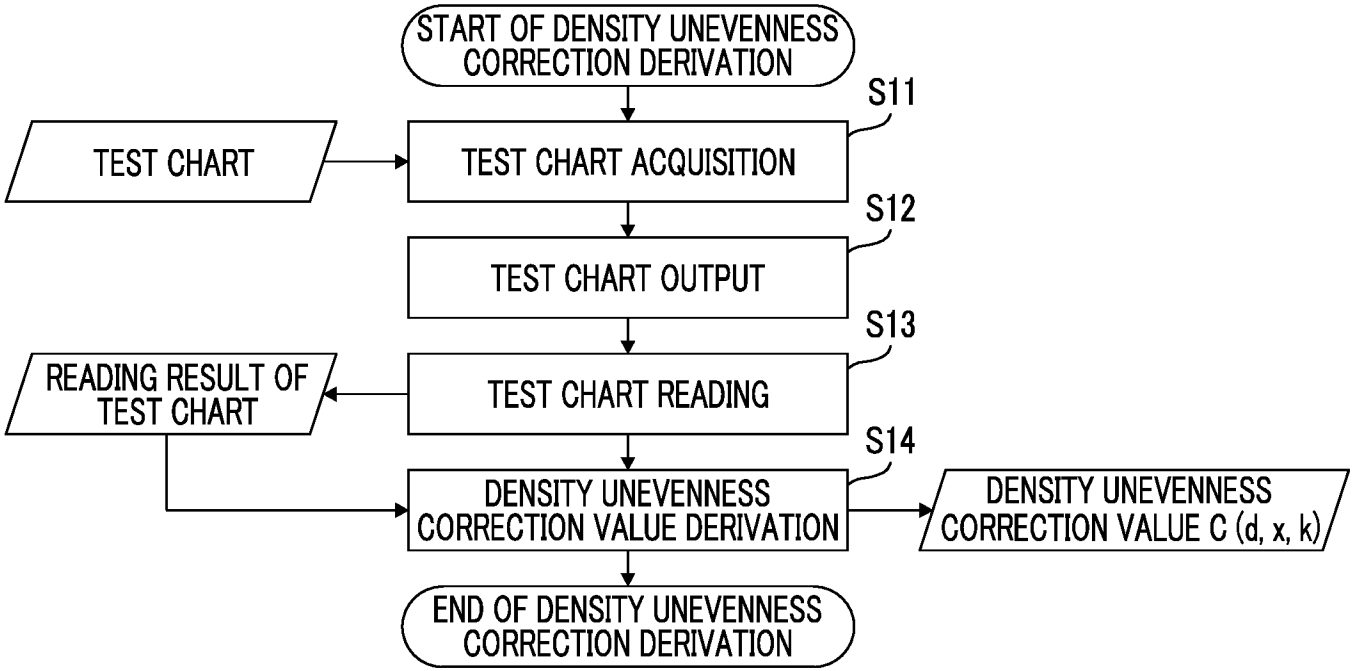
FIG. 18 is a flowchart illustrating a processing sequence of density unevenness correction value derivation processing.

FIG. 18 is a flowchart illustrating a processing sequence of density unevenness correction value derivation processing.

First, data of a test chart are acquired (Step S11). The data of the test chart are stored in the storage unit 208, and are read and acquired from the storage unit 208. The test chart TC, as illustrated in FIG. 15, includes the first chart TC1, the second chart TC2, and the third chart TC3.

Next, the test chart is output (Step S12). That is, the test chart is drawn on the paper P. One test chart is output for each color.

Next, an image of the output test chart is read (Step S13). The reading is performed by the image reader 48. The read image data of the test chart are stored in the storage unit 208.

Next, a correction value of density unevenness for each region is obtained from the reading result of the test chart (Step S14). That is, the first density unevenness correction value is obtained from the reading result of the first chart TC1, the second density unevenness correction value is obtained from the reading result of the second chart TC2, and the third density unevenness correction value is obtained from the reading result of the third chart TC3. Information on the obtained first density unevenness correction value, second density unevenness correction value, and third density unevenness correction value is stored in the storage unit 208.

From the above, the density unevenness correction value derivation processing is completed through the series of steps.

Next, density data are generated as illustrated in FIG. 17 (Step S3). That is, predetermined density conversion processing is performed on the image data of the image to be drawn on the paper P, and initial density data for each ink color are generated. Respective density values of this initial density data are expressed by d0(*x, y*). Here, x represents a position in the arrangement direction of the nozzles, and y represents a position in the transporting direction of the paper P. Hence, d0(*x, y*) shows a density value at a position (x, y) of a pixel. In addition, x is defined as x=0, 1, 2, . . . , xe−1, and xe, and y is defined as y 0, 1, 2, . . . , ye−1, and ye.

Next, density unevenness correction is performed on the initial density data (Step S4).

Figure 19:
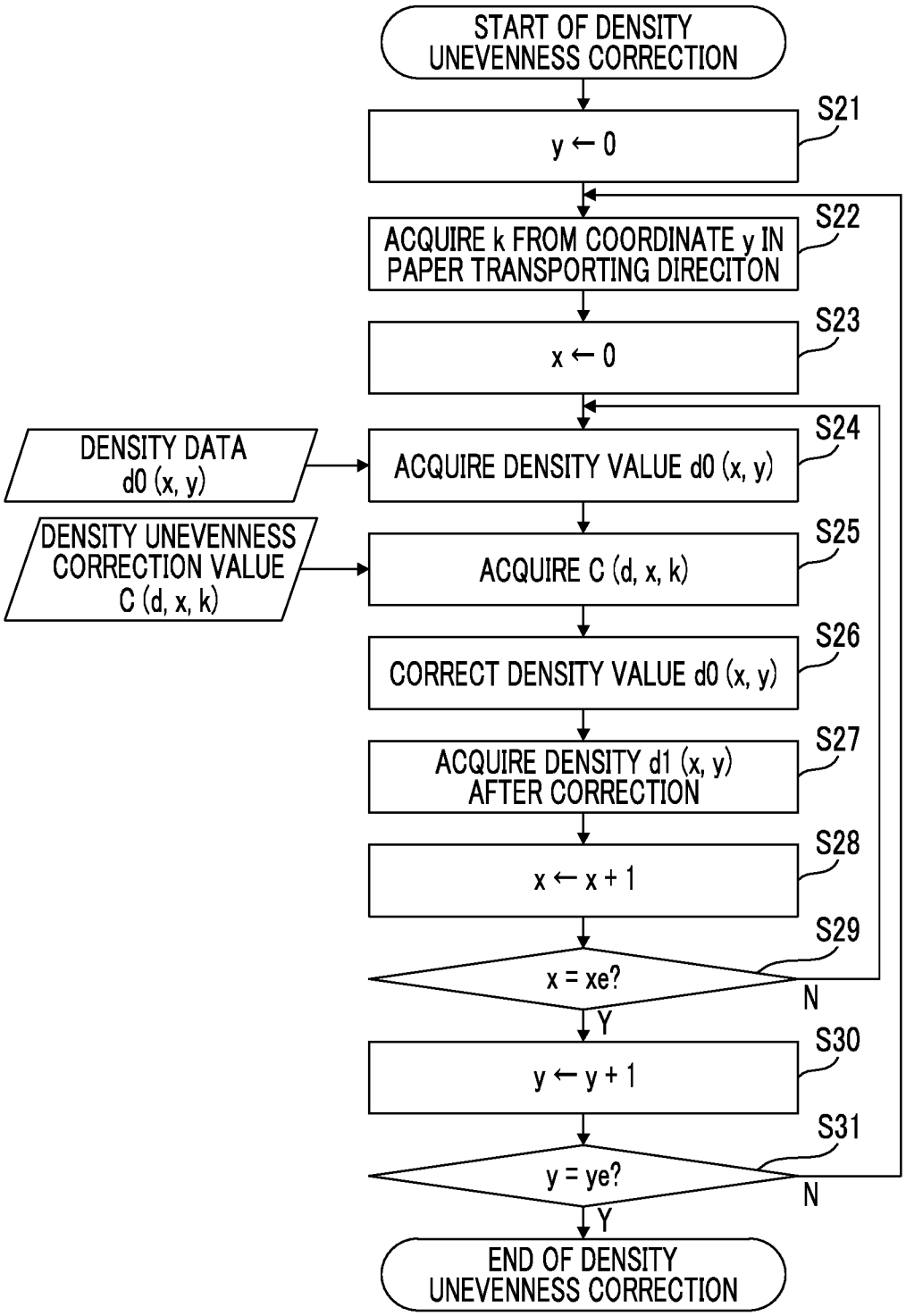
FIG. 19 is a flowchart illustrating a processing sequence of the density unevenness correction.

FIG. 19 is a flowchart illustrating a processing sequence of the density unevenness correction.

First, as y=0, the value of a y coordinate of a processing object pixel is set to 0 (Step S21).

Next, the value of k of the processing object pixel is obtained (Step S22). The value of k can be obtained from the value of they coordinate of the processing object pixel. k=k1 is established in a case where the processing object pixel belongs to the first region Z1 from the value of the y coordinate, k=k2 is established in a case where the processing object pixel belongs to the second region Z2 and k=k3 is established in a case where the processing object pixel belongs to the third region Z3.

Next, as x=0, the value of an x coordinate is set to 0 (Step S23).

Next, information on a density value d0(*x, y*) is acquired on the basis of the information on the coordinate position (x, y) of the processing object pixel (Step S24).

Next, information on a density unevenness correction value C(d, x, k) of a processing object pixel is acquired on the basis of the information on the coordinate position (x, y) of the processing object pixel and information k on a region (Step S25).

Next, the density value d0(*x, y*) of the processing object pixel is corrected using the information on the acquired density unevenness correction value C(d, x, k) (Step S26).

Next, a density value obtained by the correction is acquired as a density value dl (x, y) after the correction (Step S27). Information on the acquired density value dl(x, y) after the correction is stored in the storage unit 208.

Next, the value of the x coordinate is updated by adding 1 to the value of the x coordinate of the processing object pixel (Step S28). That is, the next pixel in the x direction of the image is set as a processing object.

Next, it is determined whether or not the value of the newly set x coordinate is xe (Step S29). That is, it is determined whether or not all processing equivalent to one line is completed.

Here, in a case where the value of the x coordinate is not xe, that is, in a case where the processing equivalent to one line is not completed, the processing returns to Step S24, and the processing from above-described Step S24 to Step S29 is executed again.

On the other hand, in a case where the value of the x coordinate is xe, that is, in a case where all processing equivalent to one line is completed, the value of the y coordinate is updated by adding 1 to the value of the y coordinate of the processing object pixel (Step S30). That is, pixels on the next line are set as processing object pixels.

Next, it is determined whether or not the value of the newly set y coordinate is ye (Step S31). That is, it is determined whether or not the processing of all the lines is all completed.

Here, in a case where the value of the y coordinate is not ye, that is, in a case where the processing of all the lines is not completed, the processing returns to Step S22 and the processing from the above-described Step S22 to Step S30 is executed again.

On the other hand, in a case where the value of the y coordinate is ye, that is, in a case where the processing of all the lines is all completed, the processing of the density unevenness correction is ended.

If the processing of the density unevenness correction ends, next, as illustrated in FIG. 17, dot arrangement data are generated from the density data after the correction, (Step S5). That is, the dot arrangement data are generated by performing half-toning processing the density data after the density unevenness correction.

Next, driving signals for the respective ink jet heads 46C, 46M, 46Y, and 46K are generated on the basis of the generated dot arrangement data (Step S6).

Preprocessing for drawing is completed in the above series of steps. Thereafter, paper feed is started to start drawing (Step S7).

As described above, in the ink jet recording device 1 of the present embodiment, the required density unevenness correction is performed on an input image to draw an image on the paper P. Additionally, when the density unevenness correction is performed, the density unevenness correction value is obtained for each region, and the density unevenness correction is performed for each region. Accordingly, a high-quality image can be drawn by appropriately correcting the density unevenness even in a case where the paper supporting part 110 of the drawing drum 100 is constituted by the supports having the comb teeth structure.

<<Other Methods for Obtaining Correction Value of Density Unevenness for Each Region>>

In the following, other methods for obtaining the correction value of the density unevenness for each region will be described.

<First Method>

A test chart to be used in this method is the same as the test chart used at the time of the density unevenness correction of the above embodiment. That is, the test chart is the test chart TC having the configuration illustrated in FIG. 15. The first chart TC1 to be drawn in the first region Z1, the second chart TC2 to be drawn in the second region Z2, and the third chart TC3 to be drawn in the third region Z3 are included in the test chart TC.

This method includes a main density unevenness component derivation step of deriving a main density unevenness component from a reading result of the test chart, a first density unevenness component derivation step of deriving a first density unevenness component, a second density unevenness component derivation step of deriving a second density unevenness component, and a density unevenness correction value derivation step of deriving a density unevenness correction value of each region on the basis of the main density unevenness component, the first density unevenness component, and the second density unevenness component.

Here, the main density unevenness component is a density unevenness component originating from an ink jet head among the density unevenness components that appear in the reading result of the test chart. Additionally, the first density unevenness component is a density unevenness component originating from the first support 112 among the density unevenness components that appear in the reading result of the test chart. Additionally, the second density unevenness component is a density unevenness component originating from the second support 114 among the density unevenness components that appear in the reading result of the test chart.

Figures 20A, 20B, 20C:
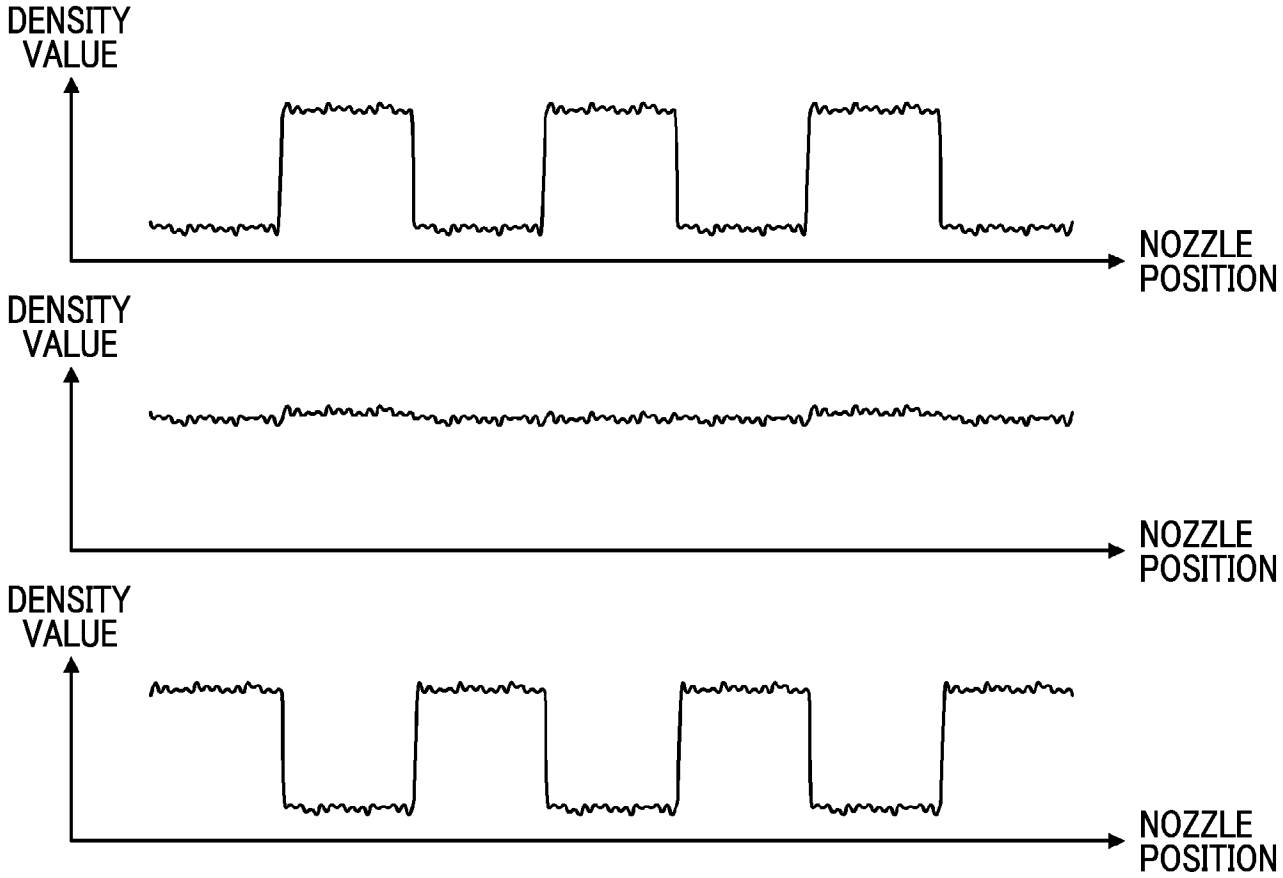
FIGS. 20A to 20C are enlarged views of some of a reading result of a certain grayscale of a chart.

FIGS. 20A to 20C are enlarged views of a portion of a reading result of a certain grayscale of a chart. FIG. 20A illustrates a reading result of the first chart TC1. Additionally, FIG. 20B illustrates a reading result of the third chart TC3. Additionally, FIG. 20C illustrates a reading result of the second chart TC2.

As illustrated in FIG. 20A, since the first chart TC1 is influenced by the first support 112, the first density unevenness component is included in the reading result, in addition to the main density unevenness component.

As illustrated in FIG. 20C, since the second chart TC2 is influenced by the second support 114, the second density unevenness component is included in the reading result, in addition to the main density unevenness component. The appearance way of the influence by the second support 114 becomes reverse to the appearance way of the influence by the first support 112.

As illustrated in FIG. 20B, since the third chart TC3 is supported by both of the first support 112 and the second support 114, there is no influence of the supports, and only the main density unevenness component mainly appears as the reading result.

[Main Density Unevenness Component Derivation Step]

In the main density unevenness component derivation step, the main density unevenness component is obtained by calculating an average of reading results of the respective charts. That is, an average of the first chart TC1, the second chart TC2, and the third chart TC3 is calculated. In this case, in the respective levels of the respective charts, reading values of corresponding positions are added, and an average thereof is obtained. That is, reading values of the same positions of the same levels are added, and an average thereof is obtained.

The main density unevenness component is obtained by the main density unevenness component derivation unit 260.

Figure 21:
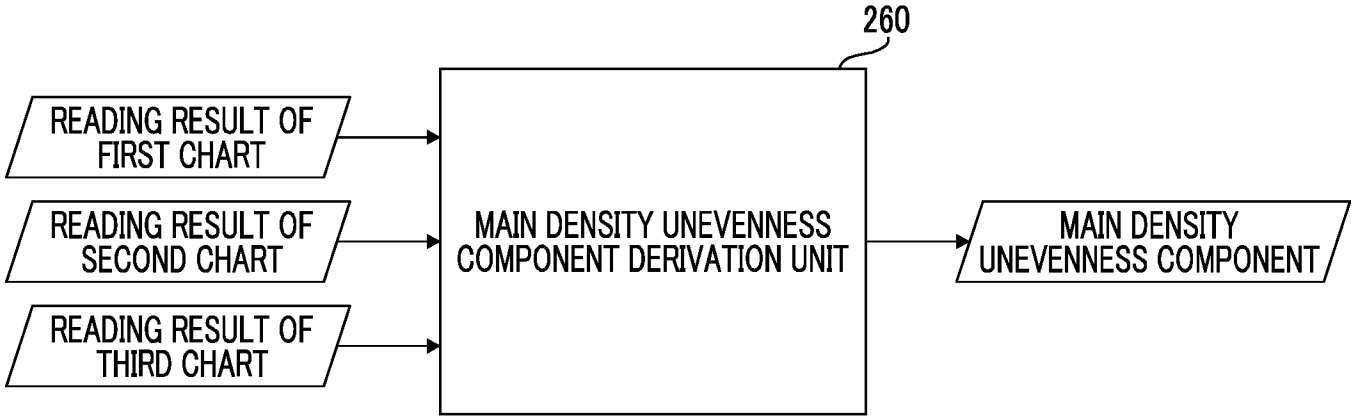
FIG. 21 is a block diagram illustrating the configuration of a main density unevenness component derivation unit.

FIG. 21 is a block diagram illustrating the configuration of the main density unevenness component derivation unit. The main density unevenness component derivation unit 260 acquires information on reading results of the first chart TC1, the second chart TC2, and the third chart TC3, and calculates an average thereof to calculate the main density unevenness component.

Here, a reading result of the first chart TC1 is defined as S1($j$, $x$), a reading result of the second chart TC2 is defined as S2($j$, $x$) and a reading result of the third chart TC3 is defined as S3($j$, $x$). j is the number of levels of each chart. As illustrated in FIG. 15, in a case where each chart is constituted of six levels, values of j=j1, j2, j6 can be taken as j. x is a position in the arrangement direction of the nozzles.

The main density unevenness component is defined as Sm(j, x). Sm(j, x) is expressed as follows.

$$Sm(j,x)=(S1(j,x)+S2(j,x)+S3(j,x))/3$$

Figures 22A, 22B, 22C:
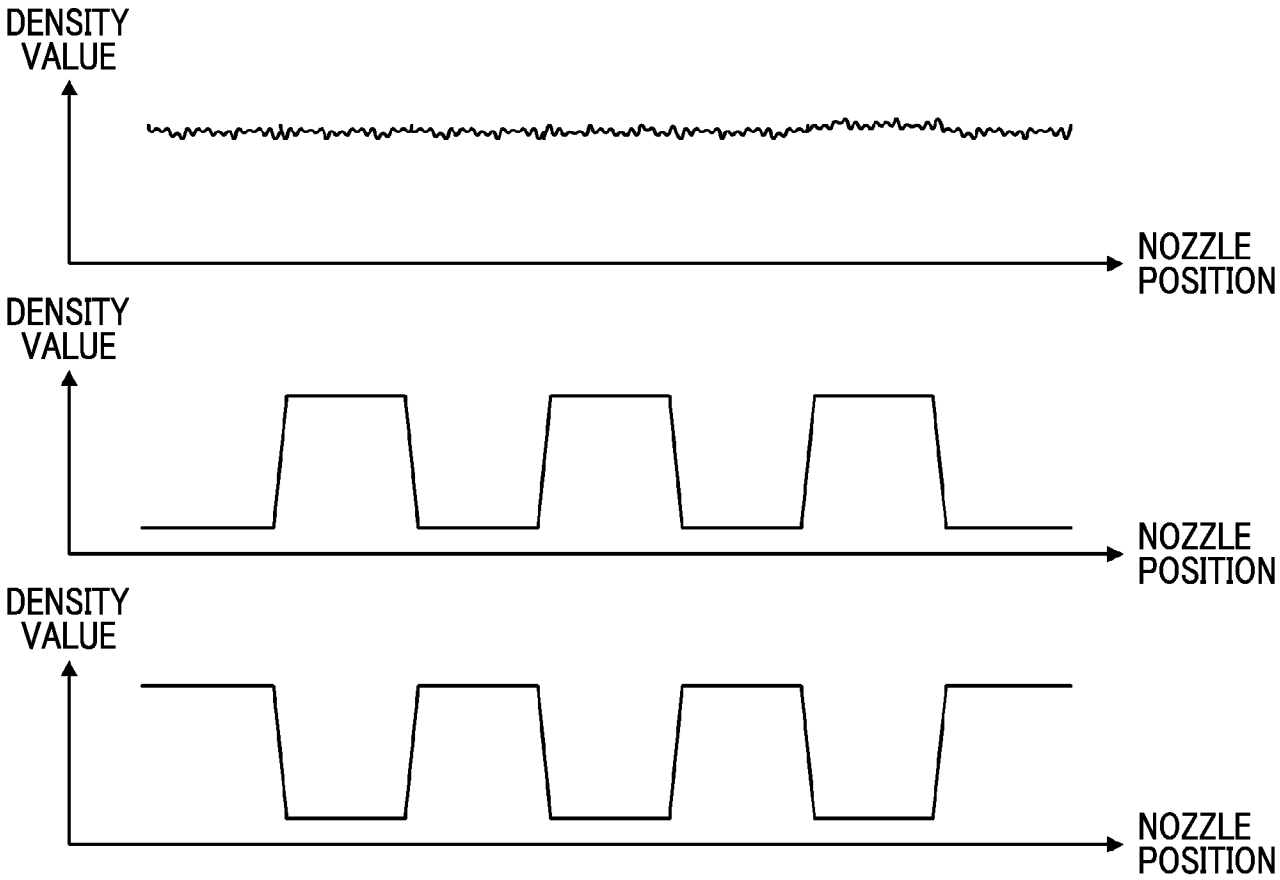
FIGS. 22A to 22C are views illustrating examples of calculation results of a main density unevenness component, a first density unevenness component, and a second density unevenness component in a certain grayscale.

FIGS. 22A to 22C are views illustrating examples of calculation results of the respective density unevenness components in a certain grayscale. FIG. 22A illustrates a calculation result of the main density unevenness component. FIG. 22B illustrates a calculation result of the first density unevenness component. FIG. 22C illustrates a calculation result of the second density unevenness component.

As illustrated in FIG. 22A, the main density unevenness component Sm(j, x) that is a density unevenness component excluding the influence of the supports can be extracted by obtaining an average of the respective charts.

[First Density Unevenness Component Derivation Step]

In the first density unevenness component derivation step, the first density unevenness component is obtained by calculating a difference between the reading result of the first chart and the main density unevenness component.

Figure 23:
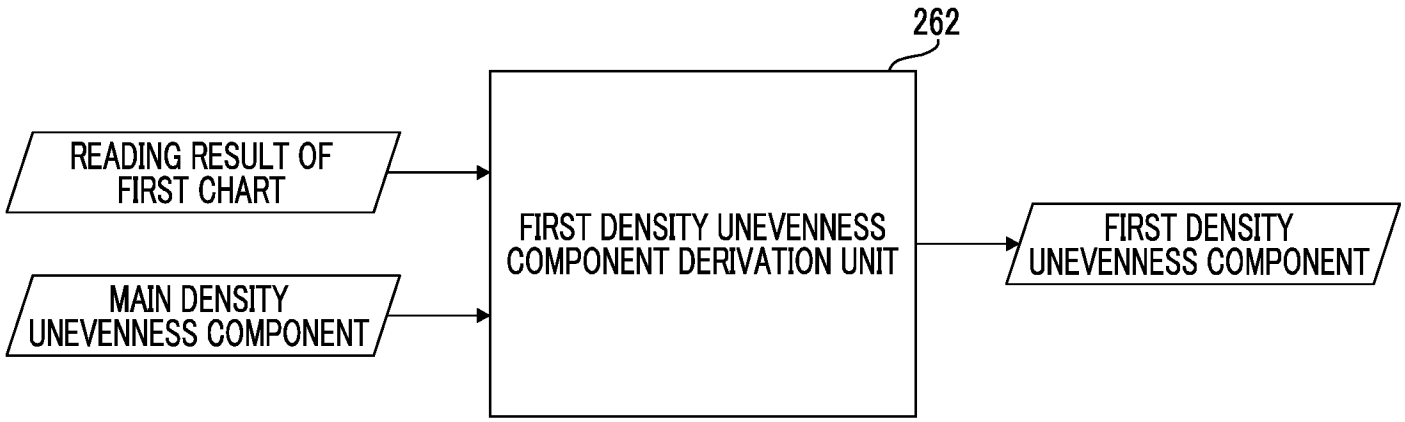
FIG. 23 is a block diagram illustrating the configuration of a first density unevenness component derivation unit.

The first density unevenness component is obtained by the first density unevenness component derivation unit 262. FIG. 23 is a block diagram illustrating the configuration of the first density unevenness component derivation unit. The first density unevenness component derivation unit 262 acquires information on the reading result of the first chart and the calculation result of the main density unevenness component, and calculates the difference therebetween to obtain the first density unevenness component.

The first density unevenness component is defined as T1(*j, x*). T1(*j, x*) is expressed as follows.

$$T1(j,x)=S1(j,x)-Sm(j,x)$$

As illustrated in FIG. 22B, the first density unevenness component T1(*j, x*) that is a density unevenness component resulting from the first support 112 can be extracted by calculating the difference between the reading result S1(*j, x*) of the first chart and the main density unevenness component Sm(j, x).

[Second Density Unevenness Component Derivation Step]

In the second density unevenness component derivation step, the second density unevenness component is obtained by calculating a difference between the reading result of the second chart and the main density unevenness component.

Figure 24:
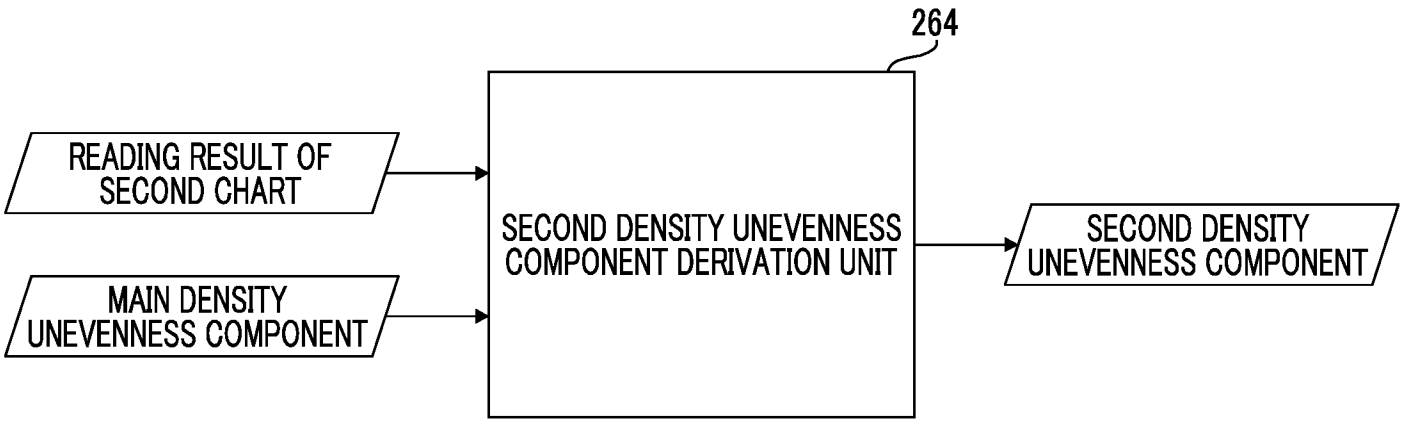
FIG. 24 is a block diagram illustrating the configuration of a second density unevenness component derivation unit.

The second density unevenness component is obtained by the second density unevenness component derivation unit 264. FIG. 24 is a block diagram illustrating the configuration of the second density unevenness component derivation unit. The second density unevenness component derivation unit 264 acquires information on the reading result of the second chart and the calculation result of the main density unevenness component, and calculates the difference therebetween to obtain the second density unevenness component.

The second density unevenness component is defined as T2(*j, x*). T2(*j, x*) is expressed as follows.

$$T2(j,x)=S2(j,x)-Sm(j,x)$$

As illustrated in FIG. 22C, the second density unevenness component T2(*j, x*) that is a density unevenness component resulting from the second support 114 can be extracted by calculating the difference between the reading result S2(*j, x*) of the second chart and the main density unevenness component Sm(j, x).

[Density Unevenness Correction Value Derivation Step]

The density unevenness correction value derivation step includes a first density unevenness correction value derivation step of deriving the first density unevenness correction value that is a density unevenness correction value of the first region Z1 on the basis of the main density unevenness component and the first density unevenness component, a second density unevenness correction value derivation step of deriving the second density unevenness correction value that is a density unevenness correction value of the second region Z2 on the basis of the main density unevenness component and the second density unevenness component, and a third density unevenness correction value derivation step of deriving the third density unevenness correction value that is a density unevenness correction value of the third region Z3 on the basis of the main density unevenness component. A density unevenness correction value of each region is derived by the density unevenness correction value derivation unit 250.

Figure 25:
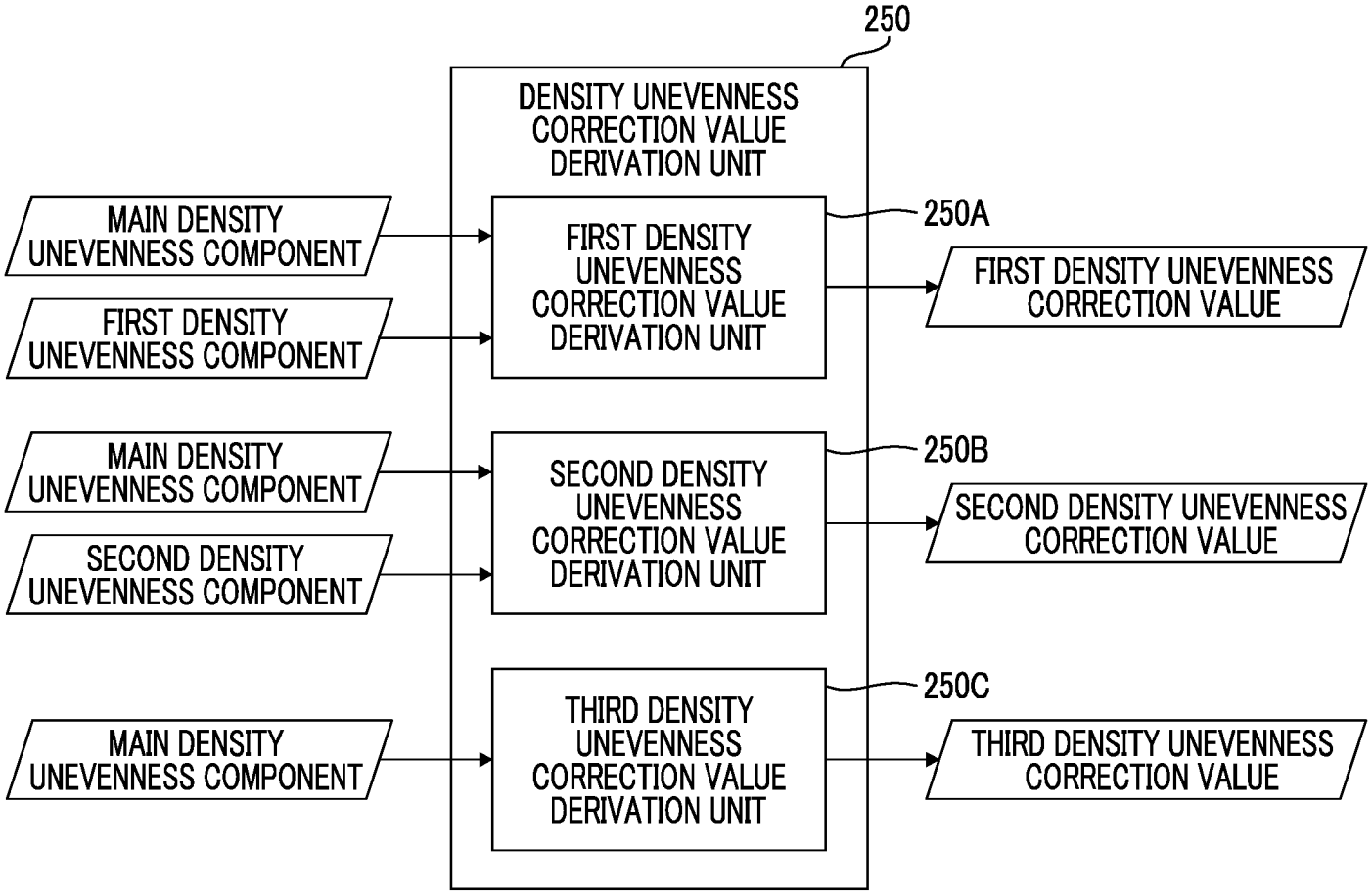
FIG. 25 is a block diagram illustrating the configuration of the density unevenness correction value derivation unit.

FIG. 25 is a block diagram illustrating the configuration of the density unevenness correction value derivation unit.

The density unevenness correction value derivation unit 250 includes the first density unevenness correction value derivation unit 250A, the second density unevenness correction value derivation unit 250B, and the third density unevenness correction value derivation unit 250C.

The first density unevenness correction value derivation unit 250A derives the first density unevenness correction value on the basis of the main density unevenness component Sm(j, x) and the first density unevenness component T1(*j, x*). That is, the correction value of the density unevenness is obtained for each grayscale such that the density value becomes uniform in the arrangement direction of the nozzles regarding each grayscale. In this case, in a case where data of a grayscale intended to obtain are not present, complementation is performed using data of another grayscale.

The second density unevenness correction value derivation unit 250B derives the second density unevenness correction value on the basis of the main density unevenness component Sm(j, x) and the second density unevenness component T2(*j, x*). In this case, in a case where data of a grayscale intended to obtain are not present, complementation is performed using data of another grayscale.

The third density unevenness correction value derivation unit 250C derives the third density unevenness correction value on the basis of the main density unevenness component Sin(j, x). In this case, in a case where data of a grayscale intended to obtain are not present, complementation is performed using data of another grayscale.

According to this method, since an average of the respective regions is taken when the main density unevenness component is obtained, noise can be reduced. Accordingly, for example, even in a case where the width of each level of a chart to be drawn in each region becomes narrow, high-precision density unevenness correction can be performed.

Modification Example of First Method

At least the first chart TC1 and the second chart TC2 may be included in a test chart to be used in the above method. That is, the first chart TC1 to be drawn in the first region Z1 and the second chart TC2 to be drawn in the second region Z2 may be included.

Figure 26:
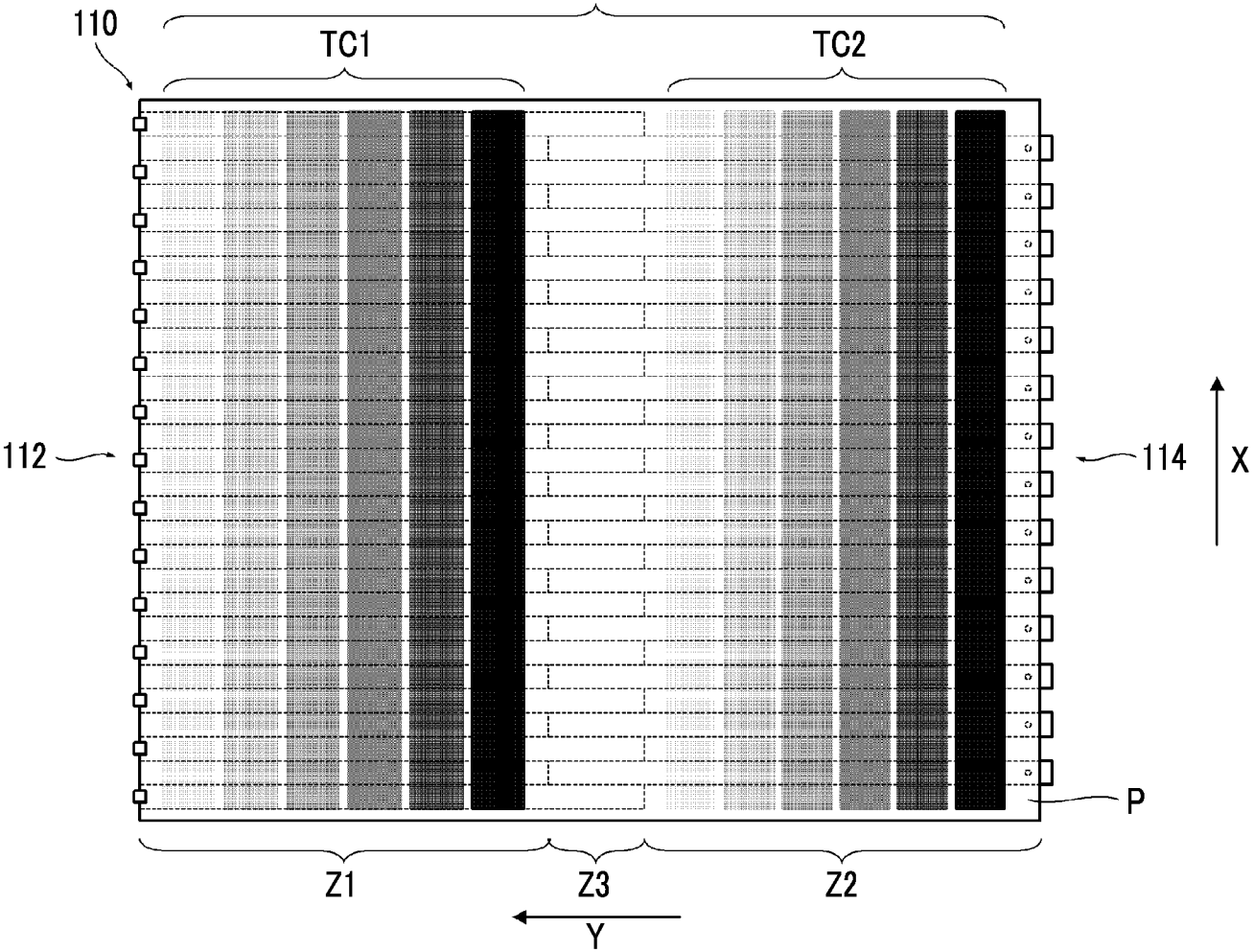
FIG. 26 is a view illustrating an example of a test chart constituted by a first chart and a second chart.

FIG. 26 is a view illustrating an example of a test chart constituted by the first chart and the second chart.

If the size of the paper P to be supported by the paper supporting part 110 becomes large, the third region Z3 becomes small. As a result, it is impossible to secure a region where the third chart is recorded.

Then, in such a case, a configuration in which the third chart is not drawn is adopted. That is, as illustrated in FIG. 26, the test chart TC is constituted by only the first chart TC1 and the second chart TC2.

The main density unevenness component, the first density unevenness component, and the second density unevenness component are obtained as follows.

As the main density unevenness component, an average of the first chart TC1 and the second chart TC2 is calculated. The main density unevenness component Sm(j, x) is expressed as follows.

$$Sm(j,x)=(S1(j,x)+S2(j,x))/2$$

As the first density unevenness component, a difference between the reading result of the first chart and the main density unevenness component is calculated. The first density unevenness component T1(*j, x*) is expressed as follows.

$$T1(j,x)=S1(j,x)-Sm(j,x)$$

As the second density unevenness component, a difference between the reading result of the second chart and the main density unevenness component is calculated. The second density unevenness component T2(*j, x*) is expressed as follows.

$$T2(j,x)=S2(j,x)-Sm(j,x)$$

On the basis of the main density unevenness component, the first density unevenness component, and the second density unevenness component that are obtained as described above, the correction value of the density unevenness is obtained for each region.

According to this method, even in a case where the third region Z3 is small, high-precision density unevenness correction can be performed.

<Second Method>

This method is also in common with the above first method in that the main density unevenness component, the first density unevenness component, and the second density unevenness component are obtained from the reading result of the test chart, and the density unevenness correction values of the respective regions are obtained on the basis of the main density unevenness component, the first density unevenness component, and the second density unevenness component.

This method is different from the above first method in terms of a method of deriving the main density unevenness component, the first density unevenness component, and the second density unevenness component.

In this method, one test chart TC is drawn on one entire paper P. That is, one test chart including a plurality of grayscales on one paper P is drawn.

Figure 27:
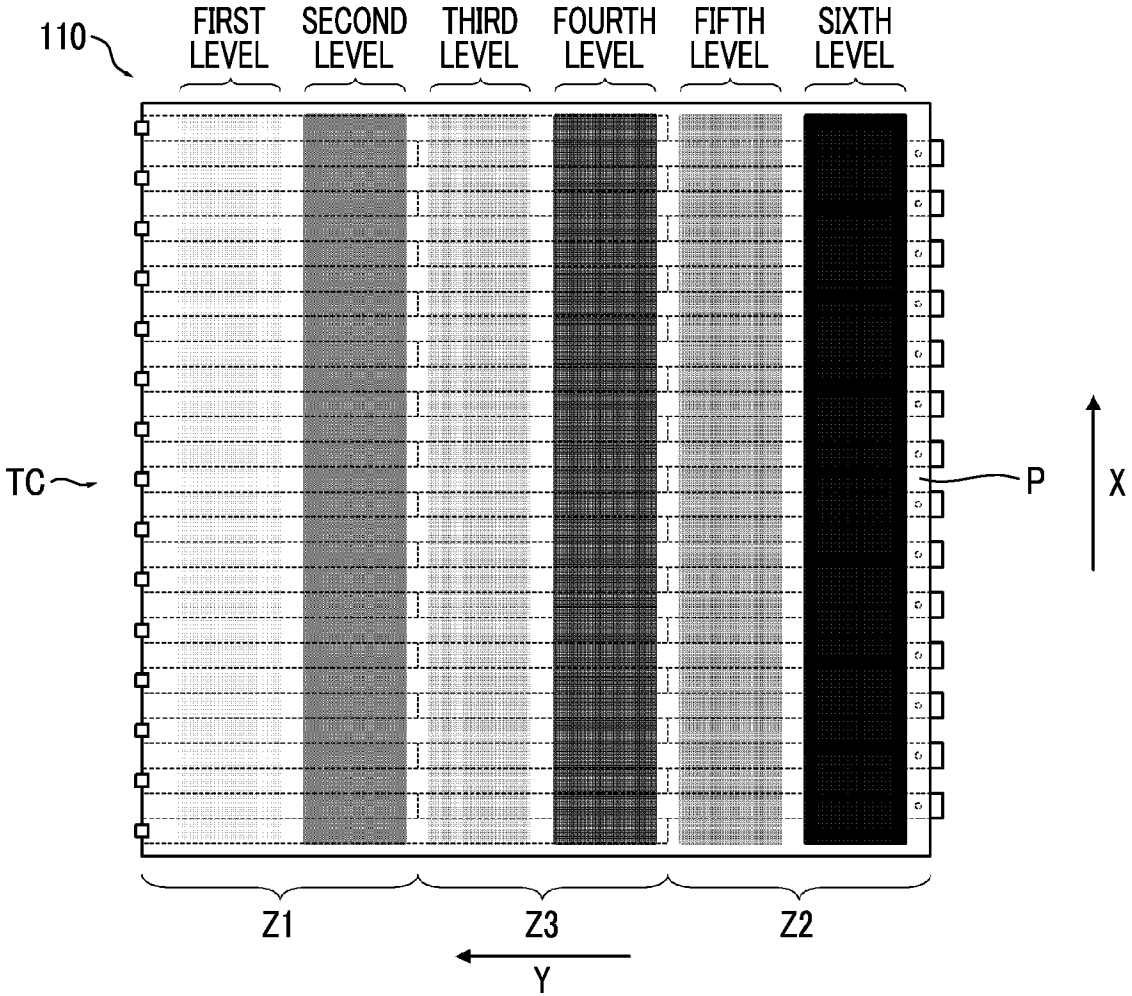
FIG. 27 is a plan view illustrating an example of a test chart to be used for the density unevenness correction.

FIG. 27 is a plan view illustrating an example of a test chart. The test chart TC is an example of a test chart TC including six grayscales. In this case, an image of the six grayscales is included in the test chart TC.

In the test chart TC, the first level image and the second level image are drawn in the first region Z1, the third level image and the fourth level image are drawn in the third region Z3, and, the fifth level image and the sixth level image are drawn in the second region Z2. In this case, the first level image is drawn in a first thin grayscale, and the second level image is drawn in a fourth thin grayscale. Additionally, the third level image is drawn in a second thin grayscale, and the fourth level image is drawn in a fifth thin grayscale. Moreover, the fifth level image is drawn in a third thin grayscale, and the sixth level image is drawn in a sixth thin grayscale, that is, in a deepest grayscale.

This method includes a density unevenness component derivation step of deriving the main density unevenness component, the first density unevenness component, and the second density unevenness component from the reading result of the test chart, and a density unevenness correction value derivation step of deriving a density unevenness correction value of each region on the basis of the main density unevenness component, the first density unevenness component, and the second density unevenness component.

<Density Unevenness Component Derivation Step>

The density unevenness component derivation step includes the main density unevenness component derivation step of deriving the main density unevenness component, the first density unevenness component derivation step of deriving the first density unevenness component, and the second density unevenness component derivation step of deriving the second density unevenness component.

Figure 28:
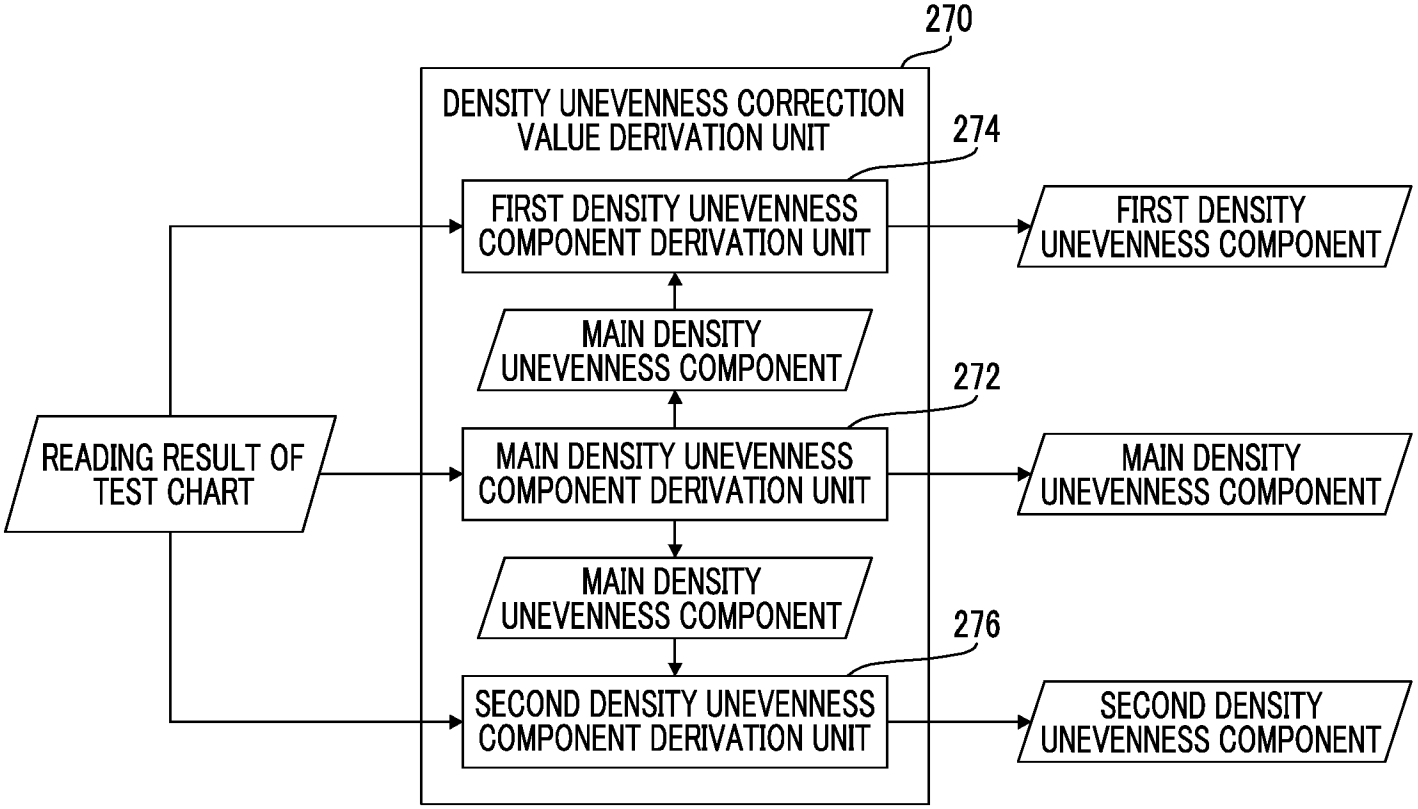
FIG. 28 is a block diagram illustrating the configuration of a density unevenness component derivation unit.

The main density unevenness component, the first density unevenness component, and the second density unevenness component are derived by the density unevenness component derivation unit 270. FIG. 28 is a block diagram illustrating the configuration of the density unevenness component derivation unit. The density unevenness component derivation unit 270 includes a main density unevenness component derivation unit 272, a first density unevenness component derivation unit 274, and a second density unevenness component derivation unit 276.

[Main Density Unevenness Component Derivation Step]

The main density unevenness component derivation step derives the main density unevenness component from the reading result of the test chart. The main density unevenness component derivation step includes a first step of Fourier-transforming the reading result of the test chart to decompose the transformed result into a plurality of frequency components, a second step that removes a fundamental frequency, and a frequency component of an integral multiple of a fundamental frequency, from the reading result of the test chart after the Fourier transform, and a third step of inverse-Fourier-transforming the reading result of the test chart after the removal, to derive the main density unevenness component.

FIGS. 29A to 29D are views illustrating a processing process of the reading result of the test chart.

Figure 29A:
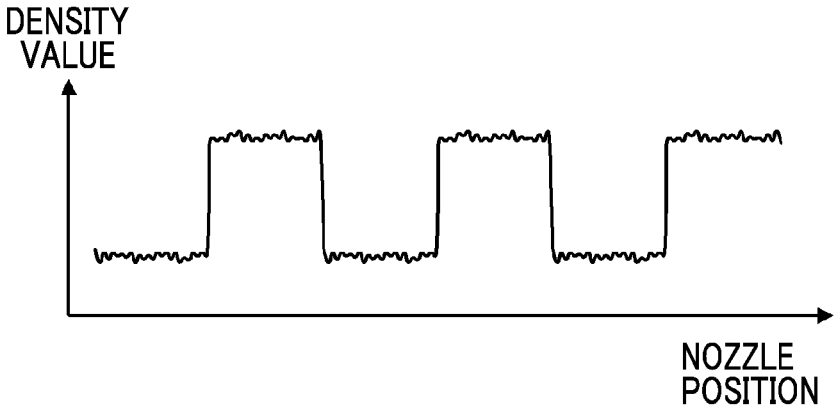
FIGS. 29A to 29D are views illustrating a processing process of a reading result of a test chart.

FIG. 29A is an extracted view of a portion of the reading result of the second level image of the test chart TC.

Since the second level image of the test chart TC is drawn in the first region Z1, the first density unevenness component other than the main density unevenness component is included in the reading result.

—First Step—

In the first step, the reading result of the test chart is Fourier-transformed and is decomposed into a plurality of frequency components.

Figure 29B:
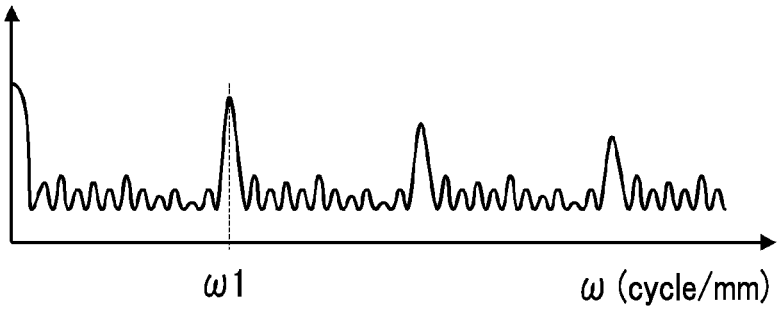

FIG. 29B is a view illustrating the reading result after the Fourier transform. The reading result of the test chart can be decomposed into the plurality of frequency components by carrying out the Fourier transform. In addition, in this drawing, a horizontal axis represents frequencies co (cycle/mm).

—Second Step—

In the second step, a fundamental frequency ω1, and a frequency component of an integral multiple of a fundamental frequency ω1 are removed from the reading result of the test chart after the Fourier transform.

Here, the fundamental frequency ω1 is a frequency matching arrangement intervals of the first supporting pieces 116 and the second supporting pieces 122 that constitute the first support 112 and the second support 114. Regarding the reading result of the test chart TC to be drawn in the first region Z1, a frequency matching arrangement intervals of the first supporting pieces 116 becomes the fundamental frequency ω1. Hence, regarding the reading results of the first level image and the second level image, the frequency matching the arrangement intervals of the first supporting pieces 116 becomes the fundamental frequency ω1. Additionally, regarding the reading result of the test chart TC to be drawn in the second region Z2, a frequency matching arrangement intervals of the second supporting pieces 122 becomes the fundamental frequency ω1. Hence, regarding the reading results of the fifth level image and the sixth level image, the frequency matching the arrangement intervals of the second supporting pieces 122 becomes the fundamental frequency ω1.

The fundamental frequency ω1 is uniquely determined from the arrangement intervals of the first supporting pieces 116 and the second supporting pieces 122. Hence, the fundamental frequency can be obtained in advance. Information on the obtained fundamental frequency ω1 is stored in the storage unit 208.

Figure 29C:
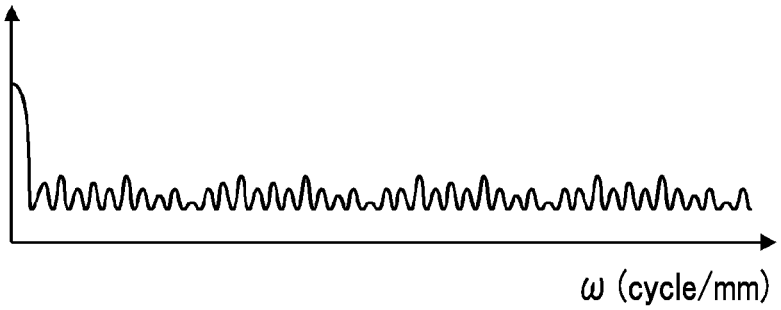

FIG. 29C is a view illustrating the reading result of the test chart after the fundamental frequency ω1 and the frequency component of the integral multiple of the fundamental frequency ω1 are removed.

The influence of the paper supporting part 110 can be removed by removing the fundamental frequency ω1 and the frequency component of the integral multiple of the fundamental frequency ω1. That is, the first density unevenness component can be removed regarding the reading result in the first region Z1, and the second density unevenness component can be removed regarding the reading result in the second region Z2.

—Third Step—

In the third step, the main density unevenness component is derived by inverse-Fourier-transforming the reading result of the test chart after the fundamental frequency ω1 and the frequency component of the integral multiple of the fundamental frequency ω1 are removed.

Figure 29D:
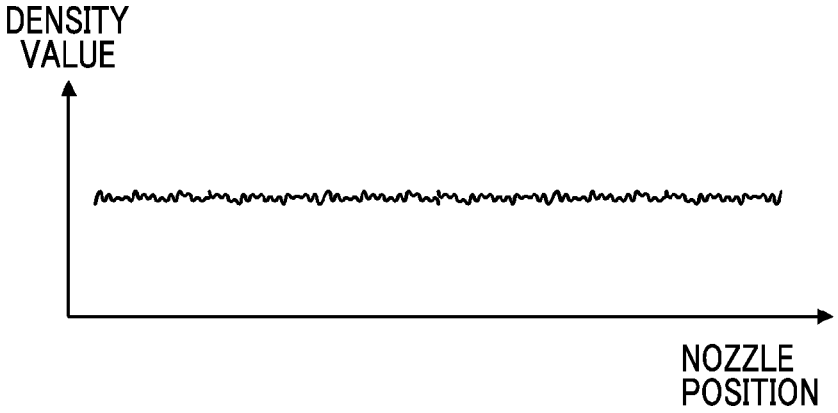
Figures 30A, 30B, 30C, 30D, 30E, 30F:
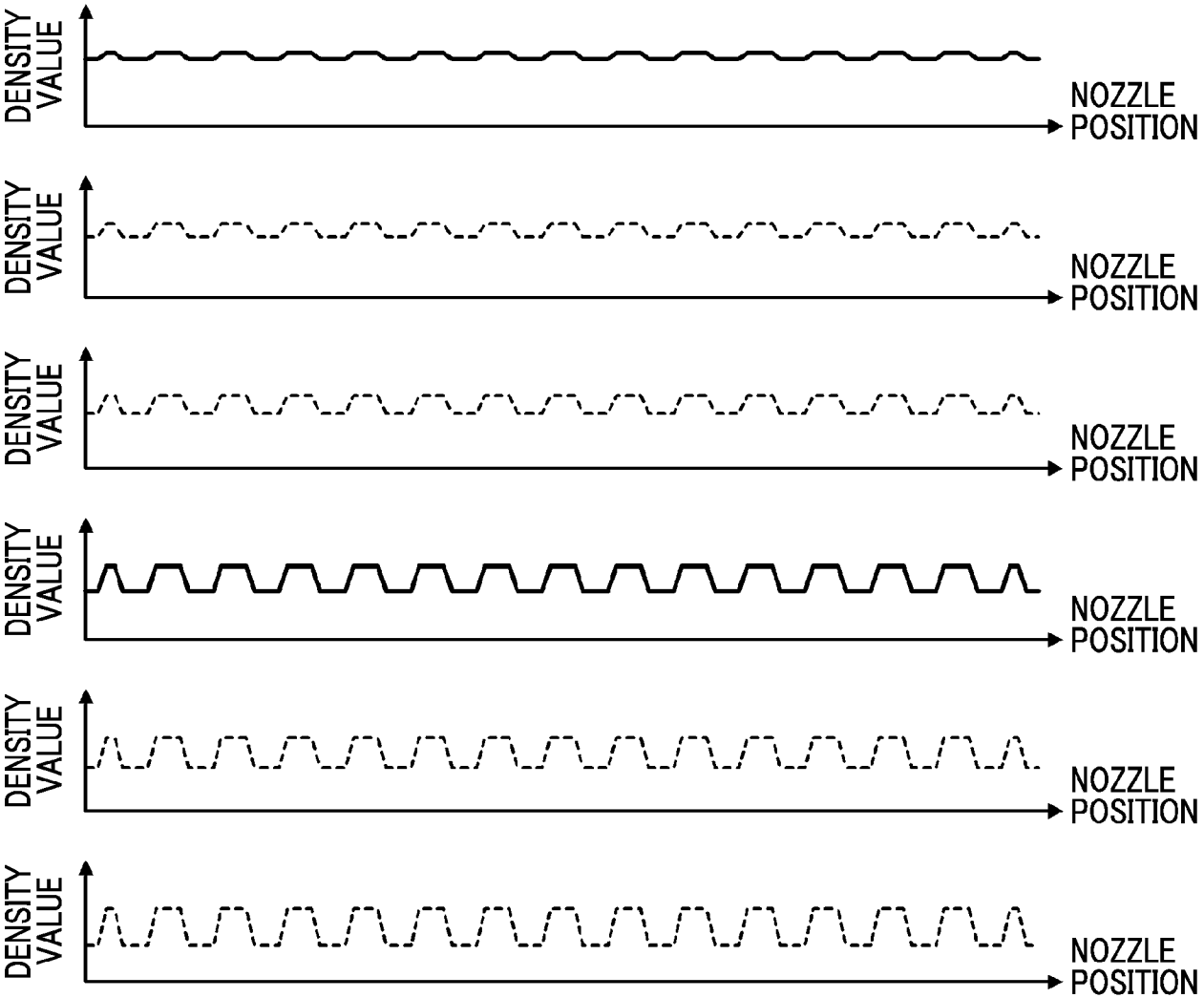
FIGS. 30A to 30F are views illustrating a method of complementing data.

FIG. 29D is a view illustrating the reading result of the test chart after the inverse Fourier transform.

The main density unevenness component is obtained by inverse-Fourier-transforming the reading result of the test chart after the fundamental frequency ω1 and the frequency component of the integral multiple of the fundamental frequency ω1 are removed.

As described above, the main density unevenness component is obtained by Fourier-transforming the reading result of the test chart, removing the fundamental frequency and the frequency component of the integral multiple of the fundamental frequency from the data after the Fourier transform, and inverse-Fourier-transforming the data after the removal. The main density unevenness component is obtained for each grayscale. A grayscale with no reading result is complemented.

As illustrated in FIG. 28, the main density unevenness component derivation unit 272 acquires the reading result of the test chart TC, and performs the above respective processings to obtain the main density unevenness component.

[First Density Unevenness Component Derivation Step]

In the first density unevenness component derivation step, the first density unevenness component is derived by calculating a difference between the reading result of the test chart and the main density unevenness component.

As illustrated in FIG. 28, the first density unevenness component derivation unit 274 acquires information on the reading result of the test chart and information on the main density unevenness component, and calculates the difference therebetween to obtain the first density unevenness component.

The first density unevenness component is also obtained for each grayscale. A grayscale with no reading result is complemented. For example, regarding the first region Z1, only reading results of grayscales equivalent to the first level image and the second level image of the test chart TC are present. Therefore, the first density unevenness components of other grayscales can be obtained using the reading results of the first level image and the second level image.

FIGS. 30A to 30F are views illustrating a method of complementing data.

In a case where only the reading results of the grayscales equivalent to the first level image and the second level image of the test chart TC are present, the first density unevenness correction components of the grayscales equivalent to the first level image and the second level image of the test chart TC can be calculated from the difference between the reading result of the test chart and the main density unevenness component.

In FIGS. 30A to 30F, it is supposed that (A) is the first density unevenness component of a grayscale equivalent to the first level image of the test chart TC and (D) is the first density unevenness component of a grayscale equivalent to the second level of test chart TC. In a case where two grayscales are present between the first level image and the second level image of the test chart TC, the two grayscales between the first level image and the second level image can be obtained from the first density unevenness component of the grayscale of the first level image, and the first density unevenness component of the grayscale of the second level image. In this case, the first density unevenness component of each grayscale is estimated by obtaining the first density unevenness component from a change tendency of the first density unevenness component of the grayscale of the first level image and the first density unevenness component of the grayscale of the second level image. The first density unevenness components of the other grayscales can be obtained similarly. In FIGS. 30A to 30F, FIGS. 30B, 30C, 30E, and 30F illustrate the first density unevenness components obtained by complement.

[Second Density Unevenness Component Derivation Step]

In the second density unevenness component derivation step, the second density unevenness component is derived by calculating a difference between the reading result of the test chart and the main density unevenness component.

As illustrated in FIG. 28, the second density unevenness component derivation unit 276 acquires information on the reading result of the test chart and information on the main density unevenness component, and calculates the difference therebetween to obtain the second density unevenness component.

The second density unevenness component is also obtained for each grayscale. A grayscale with no reading result is complemented. For example, regarding the second region Z2, only reading results of grayscales equivalent to the fifth level image and the sixth level image of the test chart TC are present. Therefore, the second density unevenness components of other grayscales can be obtained using the reading results of the fifth level image and the sixth level image.

[Density Unevenness Correction Value Derivation Step]

The density unevenness correction value derivation step is the same as the above-described first method. That is, the density unevenness correction value derivation step includes the first density unevenness correction value derivation step of deriving the first density unevenness correction value that is the density unevenness correction value of the first region Z1 on the basis of the main density unevenness component and the first density unevenness component, the second density unevenness correction value derivation step of deriving the second density unevenness correction value that is the density unevenness correction value of the second region Z2 on the basis of the main density unevenness component and the second density unevenness component, and the third density unevenness correction value derivation step of deriving the third density unevenness correction value that is the density unevenness correction value of the third region Z3 on the basis of the main density unevenness component. A density unevenness correction value of each region is derived by the density unevenness correction value derivation unit 250.

As described above, also in this method, the density unevenness correction value of each region is obtained by separating the reading result of the test chart TC into the main density unevenness component, the first density unevenness component, and the second density unevenness component. In this method, since one test chart TC is drawn on one paper P, the length of each grayscale in the paper transporting direction (Y direction) can be secured to be long. Accordingly, noise of the reading result can be reduced.

Modification Example of Second Method

A density unevenness correction value of each region can also be obtained in the following procedure.

First, a temporary density unevenness correction value for each grayscale is obtained from the reading result of the test chart TC. This temporary density unevenness correction value includes the influence of the paper supporting part 110.

Next, the temporary density unevenness correction value is Fourier-transformed, and is decomposed into a plurality of frequency components.

Next, the fundamental frequency ω1 and the frequency component of the integral multiple of the fundamental frequency ω1 are removed from the data after the Fourier transform.

Next, the data after the fundamental frequency ω1 and the frequency component of the integral multiple of the fundamental frequency ω1 are inverse-Fourier-transformed. Accordingly, the correction value of the density unevenness for correcting the main density unevenness component is obtained. This correction value is used as the main density unevenness component correction value.

Next, the density unevenness correction value of each region is obtained on the basis of information on the temporary density unevenness correction value and the main density unevenness component correction value.

Also in this method, since one test chart TC is drawn on one paper P, the length of each grayscale in the paper transporting direction (Y direction) can be secured to be long. Accordingly, noise of the reading result of each grayscale can be reduced.

Other Embodiments

<<Density Unevenness Correction Method>>

In the above embodiment, the density unevenness is corrected by performing predetermined grayscale conversion processing on the density data. However, the density unevenness correction method is not limited to this. For example, the density unevenness may be corrected by the dot arrangement data after half toning. Additionally, the density unevenness may be corrected by correcting a driving signal for each nozzle. Even in this case, a correction value is obtained for each region from a reading result of a test chart, and the density unevenness is corrected for each region.

<Medium>

In the above embodiments, a case where an image is drawn on the paper has been described as an example. However, the medium as an object to be drawn is not limited to this. The invention can be similarly applied to, for example, a case where drawing is performed on a sheet made of resin.

<Transporting Means>

In the above embodiments, the transporting means of the medium is constituted by the drum. However, the transporting means of the medium is not limited to this. The invention functions effectively as long as there is transporting means of a type in which the medium is transported in close contact with the medium supporting part configured such that the first support having the plurality of first supporting pieces arranged in the shape of comb teeth thereon and the second support having the plurality of second supporting pieces arranged in the shape of comb teeth thereon are engaged with each other and are extendable and retractable, and the medium is conveyed.

Additionally, the above embodiments have a configuration in which the medium is brought into close contact with the medium supporting part using a negative pressure. However, means for bringing the medium into contact with the medium supporting part is not limited to this. In addition to this, a configuration in which the close contact is performed using static electricity can also be adopted.

Additionally, the above embodiments have a configuration in which only the trailing end part of the paper is suctioned. However, a configuration in which the paper is suctioned as a whole can also be adopted. In this case, the suction holes are disposed in the supporting surface of each support.

Moreover, the transporting means may include means for heating or cooling a surface contacting the medium. If the means for heating or cooling the surface contacting the medium is provided, the temperature of the medium to be supported varies locally and causes the density unevenness. Even in such a case, occurrence of the density unevenness can be effectively prevented by applying the invention. As heating aspects, for example, an aspect in which a heater is built in the medium supporting part to heat the medium, an aspect in which the heat from the heater is applied to the supporting surface of the medium to heat the medium, an aspect in which a hot blast is blown against the supporting surface of the medium to heat the medium, and the like can be adopted. Additionally, as cooling aspects, for example, an aspect in which cooling means of an air cooling or water cooling type, is built in the medium supporting part to cool the medium, an aspect in which a cold blast is blown against the medium supporting surface to cooling the medium, and the like can be adopted.

<Ink Jet Head>

In the above embodiments, the nozzles are arranged in one row on the nozzle surface. However, the arrangement method of the nozzle is not limited to this. For example, the nozzles may be arranged in a matrix. Accordingly, the nozzles can be disposed in high density.

Additionally, the ink jet heads may be configured by connecting a plurality of modules. That is, one ink jet head may be connected by joining a plurality of small-sized ink jet heads including a plurality of nozzles together.

EXPLANATION OF REFERENCES

1: ink jet recording device
10: paper feed unit
12: paper feeder
14: feeder board
16: paper feed drum
20: processing liquid coating unit
22: processing liquid coating drum
24: processing liquid coating device
30: processing liquid drying unit
32: processing liquid drying drum
34: processing liquid drying device
40: drawing unit
42: paper presser roller
44: drawing unit
46C: ink jet head
46K: ink jet head
46M: ink jet head
46Y: ink jet head
48: image reader
48A: line sensor
48B: imaging lens
48C: illumination unit
50: ink drying unit
52: chain gripper
52A: chain
52B: gripper
54: paper guide
54A: first guide board
54B: second guide board
56: heating and drying device
56A: infrared lamp
60: accumulation unit
62: accumulating device
100: drawing drum
110: paper supporting part
112: first support
114: second support
116: first supporting piece
116A: first supporting surface
118: rotational axis
120: first base
122: second supporting piece
122A: second supporting surface
124: second base
126: gripper
126A: grip claw
128: suction holding part
128A: suction hole
200: computer
202: communication unit
204: operating unit
206: storage unit
208: storage unit
210: drawing control unit
212: density data generation unit
214: density unevenness correction unit
216: dot arrangement data generation unit
218: driving signal generation unit
220: head driving control unit
230: test chart output control unit
240: test chart reading control unit
250: density unevenness correction value derivation unit
250A: first density unevenness correction value derivation unit
250B: second density unevenness correction value derivation unit
250C: third density unevenness correction value derivation unit
260: main density unevenness component derivation unit
262: first density unevenness component derivation unit
264: second density unevenness component derivation unit
270: density unevenness component derivation unit
272: main density unevenness component derivation unit
274: first density unevenness component derivation unit
276: second density unevenness component derivation unit
NF: nozzle surface
Nz: nozzle
P: paper
S1 to S7: processing procedure from input of image to output
S11 to S14: processing sequence of density unevenness correction value derivation processing
S21 to S31: processing sequence of density unevenness correction
TC: test chart
TC1: first chart
TC2: second chart
TC3: third chart
Z1: first region
Z2: second region
Z3: third region

What is claimed is:

1. A density unevenness correction method for an image of an ink jet recording device, the ink jet recording device including a transporting unit having a medium supporting part configured such that a first support having a plurality of first supporting pieces arranged in the shape of comb teeth thereon and a second support having a plurality of second supporting pieces arranged in the shape of comb teeth thereon are engaged with each other and are extendable and retractable, and bringing a medium into close contact with the medium supporting part to transport the medium, and a line-type ink jet head that draws an image with a single pass on the medium transported by the transporting unit, the density unevenness correction method comprising:

a test chart output step of outputting a test chart including a plurality of grayscales;

a test chart read step of reading an image of the output test chart;

a first density unevenness correction value derivation step of deriving a first density unevenness correction value, which is a correction value of density unevenness in a first region, from a reading result of the test chart, in a case where a region where the medium is supported by only the first support is defined as the first region;

a second density unevenness correction value derivation step of deriving a second density unevenness correction value, which is a correction value of density unevenness in a second region, from the reading result of the test chart, in a case where a region where the medium is supported by only the second support is defined as the second region;

a third density unevenness correction value derivation step of deriving a third density unevenness correction value, which is a correction value of density unevenness in a third region, from the reading result of the test chart, in a case where a region where the medium is supported by the first support and the second support is defined as the third region; and a density unevenness correction step of correcting data of an image to be drawn on the medium for each region on the basis of the correction value of the density unevenness for each region.

2. The density unevenness correction method for an ink jet recording device according to claim 1, wherein the test chart includes a first chart is a chart including a plurality of grayscales and is drawn in the first region, a second chart that is a chart including a plurality of grayscales and is drawn in the second region, and a third chart that is a chart including a plurality of grayscales and is drawn in the third region, wherein the first density unevenness correction value derivation step derives the first density unevenness correction value from a reading result of the first chart, wherein the second density unevenness correction value derivation step derives the second density unevenness correction value from a reading result of the second chart, and wherein the third density unevenness correction value derivation step derives the third density unevenness correction value from a reading result of the third chart.

3. The density unevenness correction method for an ink jet recording device according to claim 1, wherein the test chart includes a first chart that is a chart including a plurality of grayscales and is drawn in the first region, and a second chart that is a chart including a plurality of grayscales and is drawn in the second region, wherein the density unevenness correction method further comprises:

a main density unevenness component derivation step of calculating an average of a reading result of the first chart and a reading result of the second chart, to derive a main density unevenness component that is a density unevenness component resulting from the ink jet head;

a first density unevenness component derivation step of calculating a difference between the reading result of the first chart and the main density unevenness component, to derive a first density unevenness component that is a density unevenness component resulting from the first support; and a second density unevenness component derivation step of calculating a difference between the reading result of the second chart and the main density unevenness component, to derive a second density unevenness component that is a density unevenness component resulting from the second support, wherein the first density unevenness correction value derivation step derives the first density unevenness correction value on the basis of the main density unevenness component and the first density unevenness component, wherein the second density unevenness correction value derivation step derives the second density unevenness correction value on the basis of the main density unevenness component and the second density unevenness component, and wherein the third density unevenness correction value derivation step derives the third density unevenness correction value on the basis of the main density unevenness component.

4. The density unevenness correction method for an ink jet recording device according to claim 3, wherein the test chart further includes a third chart that is a chart including a plurality of grayscales and is drawn in the third region, and wherein the main density unevenness component derivation step calculates an average of the reading result of the first chart, the reading result of the second chart, and the reading result of the third chart, to derive the main density unevenness component.

5. The density unevenness correction method for an ink jet recording device according to claim 1, further comprising a density unevenness component derivation step of deriving a main density unevenness component, which is a density unevenness component originating from the ink jet head, from the reading result of the test chart, a first density unevenness component that is a density unevenness component resulting from the first support, and a second density unevenness component that is a density unevenness component resulting from the second support, wherein the first density unevenness correction value derivation step derives the first density unevenness correction value on the basis of the main density unevenness component and the first density unevenness component, wherein the second density unevenness correction value derivation step derives the second density unevenness correction value on the basis of the main density unevenness component and the second density unevenness component, and wherein the third density unevenness correction value derivation step derives the third density unevenness correction value on the basis of the main density unevenness component.

6. The density unevenness correction method for an ink jet recording device according to claim 5, wherein the density unevenness component derivation step includes a main density unevenness component derivation step of deriving the main density unevenness component from the reading result of the test chart, a first density unevenness component derivation step of calculating a difference between the reading result of the test chart and the main density unevenness component, to derive the first density unevenness component, and a second density unevenness component derivation step of calculating a difference between the reading result of the test chart and the main density unevenness component, to derive the second density unevenness component.

7. The density unevenness correction method for an ink jet recording device according to claim 6, wherein the main density unevenness component derivation step includes a step of Fourier-transforming the reading result of the test chart to decompose the transformed reading result into a plurality of frequency components, a step of removing a fundamental frequency and a frequency component of an integral multiple of the fundamental frequency from the reading result of the test chart after the Fourier transform, in a case where a frequency matching arrangement intervals of the first supporting pieces and the second supporting pieces is defined as the fundamental frequency, and a step of inverse-Fourier-transforming the reading result of the test chart after the removal, to derive the main density unevenness component.

8. An ink jet recording device comprising:

a transporting unit including a medium supporting part configured such that a first support having a plurality of first supporting pieces arranged in the shape of comb teeth thereon and a second support having a plurality of second supporting pieces arranged in the shape of comb teeth thereon are engaged with each other and are extendable and retractable, and bringing a medium into close contact with the medium supporting part to transport the medium;

a line-type ink jet head that draws an image with a single pass on the medium transported by the transporting unit;

an image reading unit for reading the image drawn on the medium;

a test chart output control unit that outputs a test chart including a plurality of grayscales;

a test chart reading control unit that makes the image reading unit read an image of the output test chart;

a first density unevenness correction value derivation unit that derives a first density unevenness correction value, which is a correction value of density unevenness in a first region, from a reading result of the test chart, in a case where a region where the medium is supported by only the first support is defined as the first region;

a second density unevenness correction value derivation unit that derives a second density unevenness correction value, which is a correction value of density unevenness in a second region, from the reading result of the test chart, in a case where a region where the medium is supported by only the second support is defined as the second region;

a third density unevenness correction value derivation unit that derives a third density unevenness correction value, which is a correction value of density unevenness in a third region, from the reading result of the test chart, in a case where a region where the medium is supported by the first support and the second support is defined as the third region; and a density unevenness correction unit that corrects data of an image to be drawn on the medium for each region on the basis of the correction value of the density unevenness for each region.

9. The ink jet recording device according to claim 8, wherein the test chart includes a first chart that is a chart including a plurality of grayscales and is drawn in the first region, a second chart that is a chart including a plurality of grayscales and is drawn in the second region, and a third chart that is a chart including a plurality of grayscales and is drawn in the third region, wherein the first density unevenness correction value derivation unit derives the first density unevenness correction value from a reading result of the first chart, wherein the second density unevenness correction value derivation unit derives the second density unevenness correction value from a reading result of the second chart, and wherein the third density unevenness correction value derivation unit derives the third density unevenness correction value from a reading result of the third chart.

10. The ink jet recording device according to claim 8, wherein the test chart includes a first chart that is a chart including a plurality of grayscales and is drawn in the first region, and a second chart that is a chart including a plurality of grayscales and is drawn in the second region, wherein the ink jet recording device further comprises:

a main density unevenness component derivation unit that calculates an average of a reading result of the first chart and a reading result of the second chart, to derive a main density unevenness component that is a density unevenness component resulting from the ink jet head;

a first density unevenness component derivation unit that calculates a difference between the reading result of the first chart and the main density unevenness component, to derive a first density unevenness component that is a density unevenness component resulting from the first support; and a second density unevenness component derivation unit that calculates a difference between the reading result of the second chart and the main density unevenness component, to derive a second density unevenness component that is a density unevenness component resulting from the second support, wherein the first density unevenness correction value derivation unit derives the first density unevenness correction value on the basis of the main density unevenness component and the first density unevenness component, wherein the second density unevenness correction value derivation unit derives the second density unevenness correction value on the basis of the main density unevenness component and the second density unevenness component, and wherein the third density unevenness correction value derivation unit derives the third density unevenness correction value on the basis of the main density unevenness component.

11. The ink jet recording device according to claim 10, wherein the test chart further includes a third chart that is a chart including a plurality of grayscales and is drawn in the third region, and wherein the main density unevenness component derivation unit calculates an average of the reading result of the first chart, the reading result of the second chart, and the reading result of the third chart, to derive the main density unevenness component.

12. The ink jet recording device according to claim 8, further comprising a density unevenness component derivation unit that derives a main density unevenness component, which is a density unevenness component originating from the ink jet head, from the reading result of the test chart, a first density unevenness component that is a density unevenness component resulting from the first support, and a second density unevenness component that is a density unevenness component resulting from the second support, wherein the first density unevenness correction value derivation unit derives the first density unevenness correction value on the basis of the main density unevenness component and the first density unevenness component, wherein the second density unevenness correction value derivation unit derives the second density unevenness correction value on the basis of the main density unevenness component and the second density unevenness component, and wherein the third density unevenness correction value derivation unit derives the third density unevenness correction value on the basis of the main density unevenness component.

13. The ink jet recording device according to claim 12, wherein the density unevenness component derivation unit includes a main density unevenness component derivation unit that derives the main density unevenness component from the reading result of the test chart, a first density unevenness component derivation unit that calculates a difference between the reading result of the test chart and the main density unevenness component, to derive the first density unevenness component, and a second density unevenness component derivation unit that calculates a difference between the reading result of the test chart and the main density unevenness component, to derive the second density unevenness component.

14. The ink jet recording device according to claim 13, wherein the main density unevenness component derivation unit Fourier-transforms the reading result of the test chart to decompose the transformed reading result into a plurality of frequency components, removes a fundamental frequency and a frequency component of an integral multiple of the fundamental frequency from the reading result of the test chart after the Fourier transform, in a case where a frequency matching arrangement intervals of the first supporting pieces and the second supporting pieces is defined as the fundamental frequency, and inverse-Fourier-transforms the reading result of the test chart after the removal, to derive the main density unevenness component.

15. The ink jet recording device according to claim 8, wherein the transporting unit is a drum including the medium supporting part on an outer peripheral part thereof, and transports the medium by the rotation of the drum.

16. The ink jet recording device according to claim 8, wherein the transporting unit transports the medium with the medium being brought in close contact with the medium supporting part with a negative pressure.

17. The ink jet recording device according to claim 8, further comprising a unit for heating or cooling the transporting unit.

* * * * *